US011932464B2

(12) United States Patent
Landis et al.

(10) Patent No.: US 11,932,464 B2
(45) Date of Patent: Mar. 19, 2024

(54) BOX WITH INTERIOR LIFT MECHANISM

(71) Applicant: Buckeye Corrugated, Inc., Fairlawn, OH (US)

(72) Inventors: Jason Landis, Manheim, PA (US); Bryan Parrish, Lancaster, PA (US)

(73) Assignee: Buckeye Corrugated, Inc., Fairlawn, OH (US)

( * ) Notice: Subject to any disclaimer, the term of this patent is extended or adjusted under 35 U.S.C. 154(b) by 268 days.

(21) Appl. No.: 17/451,395

(22) Filed: Oct. 19, 2021

(65) Prior Publication Data

US 2022/0371768 A1 Nov. 24, 2022

Related U.S. Application Data

(60) Provisional application No. 63/191,743, filed on May 21, 2021.

(51) Int. Cl.
*B65D 5/20* (2006.01)
*B65D 5/22* (2006.01)
(Continued)

(52) U.S. Cl.
CPC ..... *B65D 5/2061* (2013.01); *B65D 5/2009* (2013.01); *B65D 5/2085* (2013.01);
(Continued)

(58) Field of Classification Search
CPC ..... B65D 85/1036; B65D 81/3848; B65D 77/0413; B65D 77/0446; B65D 71/72; B65D 71/50; B65D 71/42; B65D 71/403; B65D 71/40; B65D 71/063; B65D 71/0077; B65D 71/0029; B65D 71/0022;
(Continued)

(56) References Cited

U.S. PATENT DOCUMENTS 2,511,211 A 6/1950 Klein et al.
2,680,512 A 6/1954 Young
(Continued)

FOREIGN PATENT DOCUMENTS

DE 102018206467 10/2019
KR 101676545 11/2016
(Continued)

OTHER PUBLICATIONS

YouTube Video, www.youtube.com/watch?v=Sbqxw8EjZW0, published Nov. 25, 2016.

*Primary Examiner* — Kareen K Thomas
(74) *Attorney, Agent, or Firm* — Emerson, Thomson & Bennett, LLC; Roger D. Emerson; Peter R. Detorre

(57) ABSTRACT

The present disclosure is directed to a box for use in packaging, storing and displaying items. The box has a one-dimensional configuration before it is formed and a three-dimensional configuration after it is formed. The three-dimensional configuration is formed from a blank which lies flat and has a plurality of fold lines. A second blank may be employed in forming the box. The three dimensional configuration of the box includes a base portion, four side portions, a cover portion and a platform within the interior of the box that is capable of moving in an angled manner out from the interior of the box upon opening the box and of moving inside the interior of the box upon closing the box.

21 Claims, 17 Drawing Sheets

(51) Int. Cl.
*B65D 5/36* (2006.01)
*B65D 5/42* (2006.01)

(52) U.S. Cl.
CPC ..... *B65D 5/22* (2013.01); *B65D 5/3607* (2013.01); *B65D 5/4266* (2013.01); *B65D 2301/00* (2013.01)

(58) Field of Classification Search
CPC .... B65D 21/08; B65D 5/2061; B65D 5/2009; B65D 5/2085; B65D 5/22; B65D 5/3607; B65D 5/4266; B65D 2301/00; B65D 5/5213
See application file for complete search history.

(56) References Cited

U.S. PATENT DOCUMENTS 3,311,283 A 3/1967 Shimada et al.
3,768,175 A 10/1973 Hill et al.
4,498,590 A * 2/1985 Burdick ..... A45C 3/00 206/581
4,550,834 A * 11/1985 Fletcher ..... B65D 5/5435 229/940
4,646,960 A 3/1987 Challand
4,733,916 A * 3/1988 Seufert ..... B65D 5/4204 229/920
4,773,542 A * 9/1988 Schillinger ..... B65D 5/4266 229/905
5,603,558 A 2/1997 Zimmer
5,657,875 A 8/1997 Hirsh, III et al.
5,682,999 A 11/1997 Larson
5,765,504 A 6/1998 Evans et al.
6,431,363 B1 8/2002 Hacker
6,523,693 B1 2/2003 Eggenberger et al.
6,915,949 B1 7/2005 Economopoulos
7,455,182 B2 11/2008 Merckell
7,909,168 B2 3/2011 Virvo
8,985,329 B2 3/2015 Ullrich
9,289,047 B2 3/2016 Limongi et al.
9,371,151 B2 6/2016 Nadeau
9,873,542 B2 1/2018 Krutsch
10,239,653 B2 3/2019 Putko
10,696,446 B2 6/2020 Lee et al.
2006/0266811 A1 11/2006 Clegg et al.
2008/0118900 A1 5/2008 Salerni
2015/0014404 A1 1/2015 Iwata et al.
2016/0362217 A1* 12/2016 Hajek ..... B65D 5/667
2017/0166372 A1* 6/2017 Bugas ..... B65D 5/563
2017/0210533 A1* 7/2017 Couvillon ..... B65D 5/008
2017/0217629 A1* 8/2017 Buscema ..... B65D 5/003
2018/0009564 A1* 1/2018 Carman ..... B65D 5/103
2018/0134442 A1* 5/2018 Yuasa ..... B65D 5/6664
2018/0148218 A1* 5/2018 Yuasa ..... B65D 5/6664
2018/0170636 A1* 6/2018 Prince ..... B65D 5/0227
2018/0354674 A1* 12/2018 Hodge ..... B65D 5/4266

FOREIGN PATENT DOCUMENTS

WO 2013131616 9/2013
WO 2016108120 7/2016

* cited by examiner

BOX WITH INTERIOR LIFT MECHANISM

TECHNICAL FIELD

The present disclosure generally relates to a box for packaging, storing and displaying items, methods of assembling a box and methods for using the box.

BACKGROUND

Numerous type of boxes have been developed and used for storing, shipping and displaying products. In most cases the size, shape and function of the box depends on the particular needs of the manufacturer or shipper.

While various types of boxes exist for storing and shipping goods and even displaying goods, the present box design provides an interior lift mechanism for raising and lowering platform within the interior of the box. This feature of a lift mechanism allows the interior contents of the box to be raised or lifted from the interior of the box within the opening of the box. By lifting the contents of the box from the interior of the box, the box provides a user with easier access to the interior contents of the box. In addition, the box may also function as a display for the contents stored within the interior of the box when the box is in its open configuration. Thus, the lift mechanism of the present box also provides a means for displaying the goods stored within the box. The present disclosure contemplates that these goods may be stored within a second smaller box or other type of packaging material within the interior of the box or not.

SUMMARY

Provided is a box blank kit. The box blank kit includes a main body box blank. The main body box blank includes the following features: a base portion having a first side, a second side opposing the first side of the base portion, a third side and a fourth side opposing the third side of the base portion; a first sidewall exterior portion which extends from the first side of the base portion and a second sidewall exterior portion which extends from the second side of the base portion; a third sidewall portion which extends from the third side of the base portion, wherein the third sidewall portion has a first side, a second side opposing the first side of the third sidewall portion, a third side, and a fourth side opposing the third side of the third sidewall portion; a fourth sidewall portion which extends from the fourth side of the base portion, wherein the fourth sidewall portion has a first side, a second side opposing the first side of the fourth sidewall portion, a third side, and a fourth side opposing the third side of the fourth sidewall portion; a cover portion which extends from the third side of the third sidewall portion, wherein the cover portion has a first side, a second side opposing the first side of the cover portion, a third side, and a fourth side opposing the third side of the cover portion; a cover interior portion having a first side, a second side opposing the first side of the cover interior portion, a third side and a fourth side opposing the third side of the cover interior portion, wherein the cover interior portion extends from—i) the first side of the cover portion or ii) the second side of the cover portion, wherein the cover interior portion comprises a slot; a first intermediate platform portion which extends from the fourth side of the fourth sidewall portion, wherein the first intermediate platform portion has a first side, a second side opposing the first side of the first intermediate platform portion, a third side, and a fourth side opposing the third side of the first intermediate platform portion; a platform portion which extends from the fourth side of the first intermediate platform portion, wherein the platform portion has a first side, a second side opposing the first side of the platform portion, a third side, and a fourth side opposing the third side of the platform portion; a second intermediate platform portion which extends from the fourth side of the platform portion, wherein the second intermediate platform portion has a first side, a second side opposing the first side of the second intermediate platform portion, a third side, and a fourth side opposing the third side of the second intermediate platform portion; a tabular portion which extends from the fourth side of the second intermediate platform portion, wherein the tabular portion fits in the slot of the cover interior portion.

According to further aspects of the present teaching, the main body box blank further includes: a first sidewall interior portion which extends from the first sidewall exterior portion, wherein the first sidewall interior portion has a first side, a second side opposing the first side of the first sidewall interior portion, a third side, and a fourth side opposing the third side of the first sidewall interior portion; and a second sidewall interior portion which extends from the second sidewall exterior portion, wherein the second sidewall interior portion has a first side, a second side opposing the first side of the second sidewall interior portion, a third side, and a fourth side opposing the third side of the second sidewall interior portion.

According to further aspects of the present teaching, the third sidewall portion includes a first side insert portion which extends from the first side of the third sidewall portion and a second side insert portion which extends from the second side of the third sidewall portion, and the fourth sidewall portion includes a first side insert portion which extends from the first side of the fourth sidewall portion and a second side insert portion which extends from the second side of the fourth sidewall portion.

According to further aspects of the present teaching, the flap portion includes a first side insert portion which extends from the first side of the flap portion and a second side insert portion which extends from the second side of the flap portion.

According to further aspects of the present teaching, the first sidewall interior portion includes at least one tab which extends from its first side and wherein at least one slot is positioned between the first side of the base portion and the third side of the first sidewall exterior portion corresponding to said tab and the second sidewall interior portion includes at least one tab which extends from its second side and wherein at least one slot is positioned between the third side of the base portion and the first side of the second sidewall exterior portion corresponding to said tab.

According to further aspects of the present teaching, a first side portion extends from the first side of the cover portion and a second side portion extends from the second side of the cover portion, wherein the first side portion has a first side, a second side opposing the first side of the first side portion, a third side, and a fourth side opposing the third side of the first side portion and wherein the second side portion has a first side, a second side opposing the first side of the second side portion, a third side, and a fourth side opposing the third side of the second side portion.

According to further aspects of the present teaching, the cover interior portion extends from—i) the first side portion which extends from the first side of the cover portion or ii) the second side portion which extends from the second side of the cover portion.

According to further aspects of the present teaching, the main body box blank includes a cover interior insert portion having a first side, a second side opposing the first side, a third side and a fourth side opposing the third side of the cover interior portion, wherein the cover interior portion extends from—i) the first side portion which extends from the first side of the cover portion or ii) the second side portion which extends from the second side of the cover portion.

According to further aspects of the present teaching, the cover interior insert portion extends from the first side of the first side portion which extends from the first side of the cover portion and the cover interior portion extends from the second side of the second side portion which extends from the second side of the cover portion.

According to further aspects of the present teaching, the main body box blank of further includes at least one tab positioned at the second side of the cover interior portion and at least one corresponding slot positioned between the first side of the first side portion extending from the cover portion and the second side of the cover interior insert portion.

According to further aspects of the present teaching, the main body box blank includes two tabs positioned at the second side of the cover interior portion and two corresponding slots positioned along a fold line between the first side of the first side portion extending from the cover portion and the second side of the cover interior insert portion.

According to further aspects of the present teaching, the third side of the cover interior portion comprises a concave curvilinear edge which extends from the first side of the cover interior portion to the second side of the cover interior portion.

According to further aspects of the present teaching, the third side of the cover interior portion comprises an angled edge which extends upward from the first side of the cover interior portion to the second side of the cover interior portion and wherein the fourth side of the cover interior portion comprises an angled edge which extends downward from the first side of the cover interior portion to the second side of the cover interior portion.

According to further aspects of the present teaching, the third side of the first side portion which extends from the first side of the cover portion includes a curvilinear edge which slopes upward from the first side of the first side portion to the second side of the first side portion of the cover portion; the fourth side of the first side portion which extends from the first side of the cover portion includes an angled edge which slopes downward from the first side of the first side portion to the second side of the first side portion of the cover portion; the third side of the second side portion which extends from the second side of the cover portion includes a curvilinear edge which slopes downward from the first side of the second side portion to the second side of the second side portion of the cover portion; and, the fourth side of the second side portion which extends from the second side of the cover portion includes an angled edge which slopes upward from the first side of the second side portion to the second side of the second side portion of the cover portion.

According to further aspects of the present teaching, the platform portion includes a first flange portion which extends from the first side of the platform portion and a second flange portion which extends from the second side of the platform portion.

According to further aspects of the present teaching, the first flange portion includes a slot and the second side flange portion comprises a slot.

According to further aspects of the present teaching, the box blank kit includes a product strap blank, wherein the product strap blank has a top side, a bottom side, a first end and a second end capable of being fitted across the platform portion by fitting a first end of the product strap inside the slot on the first side flange portion and fitting a second end of the product strap inside the slot on the second side flange portion.

According to further aspects of the present teaching, product strap includes a main body portion having a top side and a bottom side, wherein the top side of the main body portion extends upward from the top side of the product strap and the bottom side of the main body portion extends downward from the bottom side of the product strap.

According to further aspects of the present teaching, the first end of the product strap includes a projecting portion which extends upward from the top side of the product strap and which extends downward from the bottom side of the product strap and wherein the second end of the product strap comprises a projecting portion which extends upward from the top side of the product strap and which extends downward from the bottom side of the product strap.

According to further aspects of the present teaching, the product strap blank includes a first side portion adjacent a first side of the main body portion, wherein the first side portion extends towards the first end of the product strap blank and a second side portion adjacent a second side of the main body portion, wherein the second side portion extends toward the second end of the product strap blank.

According to further aspects of the present teaching, the product strap blank includes a first connecting portion between the first side portion and the first end of the product strap blank and a second connecting portion between the second side portion and the second end of the product strap.

According to further aspects of the present teaching, main body box blank of the box blank kit includes: a fold line between the base portion and the first sidewall exterior portion; a fold line between the base portion and the second sidewall exterior portion; a fold line between the base portion and the third sidewall portion; a fold line between the base portion and the fourth sidewall portion; a fold line between the first sidewall exterior portion and the first sidewall interior portion; a fold line between the second sidewall exterior portion and the second sidewall interior portion; a fold line between the third sidewall portion and the first side insert of the third sidewall portion; a fold line between the third sidewall portion and the second side insert of the third sidewall portion; a fold line between the third sidewall portion and the cover portion; a fold line between the cover portion and the first side portion of the cover portion; a fold line between the cover portion and the second side portion of the cover portion; a fold line between the first side portion of the cover portion and the cover interior insert portion; a fold line between the second cover exterior portion and the second cover interior portion; a fold line between the second side portion of the cover portion and the cover interior portion; a fold line between the cover portion and the flap portion; a fold line between the flap portion and the first side insert portion of the flap portion; a fold line between the flap portion and the second side insert portion of the flap portion; a fold line between the fourth sidewall portion and the first side insert portion of the fourth sidewall portion; a fold line between the fourth sidewall portion and the second side insert portion of the fourth sidewall portion;

a fold line between the fourth sidewall portion and the first intermediate platform portion; a fold line between the first intermediate platform portion and the platform portion; a fold line between the platform portion and the first flange portion; a fold line between the platform portion and the second flange portion; a fold line between the platform portion and the second intermediate platform portion; and a fold line between the second intermediate platform portion and the tabular portion; and the product strap blank includes: a fold line between the main body portion and the first side portion of the product strap blank; a fold line between the main body portion and the second side portion of the product strap blank; a fold line between the first side portion and the first connecting portion of the product strap blank; a fold line between the second side portion and the second connecting portion of the product strap blank; a fold line between the first connecting portion and the first end of the product strap blank; and, a fold line between the second connecting portion and the second end of the product strap blank.

Provided is a method of forming a box from a box blank it including the following steps: folding the first sidewall portion and the second sidewall portion upwards with respect to the base portion; folding the first sidewall interior portion downwards with respect to the first sidewall exterior portion and inserting the at least one tab extending from the first side of the first sidewall interior portion in the at least one corresponding slot positioned between the base and the first sidewall exterior portion; folding the second sidewall interior portion downwards with respect to the second sidewall exterior portion and inserting the at least one tab extending from the second side of the second sidewall interior portion in the at least one corresponding slot positioned between the base and the second sidewall exterior portion; folding the third sidewall portion upwards with respect to the base portion; folding the fourth sidewall portion upwards with respect to the base portion; folding the first side insert and the second side insert of the third sidewall portion upward with respect to a top surface of the third sidewall portion and inserting the first side insert between the first sidewall exterior portion and the first sidewall interior portion and inserting the second side insert between the second sidewall exterior portion and the second sidewall interior portion; folding the first side insert and the second side insert of the fourth sidewall portion upward with respect to a top surface of the fourth sidewall portion and inserting the first side insert between the first sidewall exterior portion and the first sidewall interior portion and inserting the second side insert between the second sidewall exterior portion and the second sidewall interior portion; folding the cover portion upward with respect to the third sidewall portion; folding the first side portion of the cover portion and the second side portion of the cover portion upward with respect to the cover portion; folding the cover interior insert portion upward with respect to the first side portion of the cover portion; folding the cover interior portion upward with respect to the second side portion; inserting the at least one tab extending from the second side of the cover interior portion in the at least one corresponding slot positioned between the first side portion of the cover portion and the cover interior insert portion; applying an adhesive between the cover interior insert portion and the cover interior portion; folding the flap portion upward with respect to the cover portion; folding the first side insert and the second side insert of the flap portion upward with respect to the flap portion; folding the first interior platform portion upward with respect to the fourth sidewall portion; folding the platform portion downward with respect to the first interior platform portion; folding the second interior platform portion downward with respect to the platform portion; folding the tabular portion upward with respect to the second interior platform portion and inserting the tabular portion in the slot positioned on the cover interior portion; folding the first flange portion and the second flange portion upward with respect to the platform portion; and forming a product strap from the product strap blank according to the following steps: folding the first side portion and the second side portion downward with respect to the main body portion of the product strap blank; folding the first side connecting portion downward with respect to the first side portion of the product strap blank and the second side connecting portion downward with respect to the second side portion of the product strap blank; inserting the first end of the product strap blank in the slot positioned between the first flange portion and the platform portion; inserting the second end of the product strap blank in the slot positioned between the second flange portion and the platform portion; applying an adhesive between the first end and first connecting portion of the product strap and the platform portion; and, applying an adhesive between the second end and second connecting portion of the product strap and the platform portion.

Provided is a box. The box includes the following features: an exterior box structure comprising a first exterior sidewall, a second exterior sidewall, a third exterior sidewall, a fourth exterior sidewall, a bottom surface and a cover portion which extends from the third exterior sidewall, wherein the first exterior sidewall, second exterior sidewall, third exterior sidewall and fourth exterior sidewall form an interior space; a cover interior portion which extends from the cover portion, wherein the cover interior portion comprises a slot; a first platform intermediate portion positioned over the bottom surface of the box within an interior portion of the box, wherein the first platform intermediate portion extends from the fourth sidewall portion; a platform portion positioned over the bottom surface of the box within an interior portion of the box, wherein the platform portion extends from the first platform intermediate portion; a second platform intermediate portion positioned over the bottom surface of the box within an interior portion of the box, wherein the second platform intermediate portion extends from the platform portion; a tabular portion extending from the second platform intermediate portion and inserted in the slot on the cover interior portion thereby forming an interior lift mechanism; a first flange which extends from a first side of the platform portion and a second flange which extends from a second side of the platform portion; a first slot positioned between the first flange and the platform portion and a second slot positioned between the second flange and the platform portion; a product strap comprising a first end inserted in the first slot positioned between the first flange and the platform portion and a second end inserted in the second slot positioned between the second flange and the platform portion; wherein upon lifting the cover portion upward, the platform portion through its connection to the cover interior portion via the second platform intermediate portion and tabular portion lifts upward at an angle from the interior of the box so that a portion of the platform portion extends out from the interior of the box, and wherein upon lowering the cover portion downward, the platform portion through its connection to the cover interior portion via the second platform intermediate portion and tabular portion lowers downward closing the angle to fit within the interior of the box.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the invention in sufficient detail to enable one of ordinary skill in the art to which the invention pertains to make and use the invention.

DETAILED DESCRIPTION

The present disclosure is directed to a box having an interior lift mechanism or levitation device within its interior. The lift mechanism/levitation device includes a platform which is connected to the inner sides of a hinged box cover. The lift mechanism/levitation device functions to raise and lower the platform at an angle within the interior of the box with the opening and closing of the hinged box cover. This and other features of the box are discussed in the detail description below.

The present disclosure overcomes the foregoing and other shortcomings and drawbacks of boxes heretofore known for use in various environments and applications. While various embodiments are discussed in detail herein, it will be understood that the invention is not limited to these embodiments. On the contrary, the invention includes all alternatives, modifications and equivalents as may be included within the spirit and scope of the present invention.

The present disclosure relates to a box having both a first flat and one-dimensional configuration and a second three-dimensional configuration. The box transitions between the first configuration to the second configuration through folding and/or unfolding and shaping of its components. The box may be used as a packaging device to store items placed within it for sale and as a display for selling items stored within it. In certain configurations, the box is capable of storing cigars, cigarettes, pens, pencils or similarly shaped items. The box has a closed configuration which allows for protection and transport of items stored in it and an open configuration which provides access to and allows for display of items stored in it. The box may be used as a general storing container and as a display device when it is opened.

The box includes an interior lift mechanism (also referred to as a levitation device) which includes a platform attached to the inner side of a hinged cover. Upon opening the hinged cover, the lift mechanism causes the platform to rise or lift upwards at an angle from the interior of the box. The lift mechanism further causes the platform to lower into the interior of the box upon closing the hinged cover. The platform is capable of holding various types of packaged and unpackaged items and may further be used as a display of items stored in the box when the box is in its opened configuration.

Figure 3:
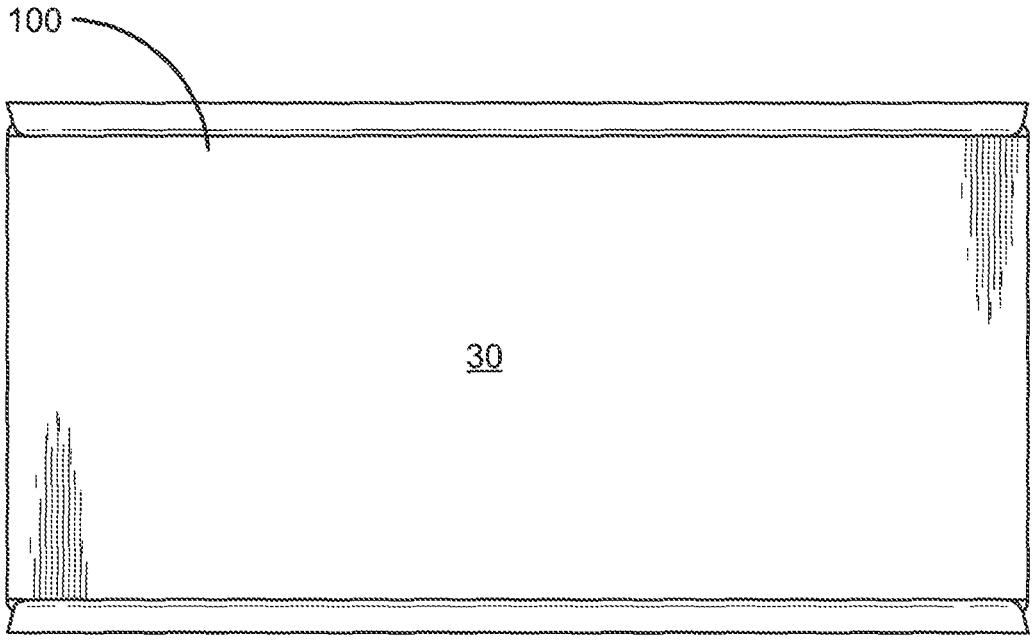
FIG. 3 shows an exemplary embodiment of a box in a closed configuration.
Figure 4:
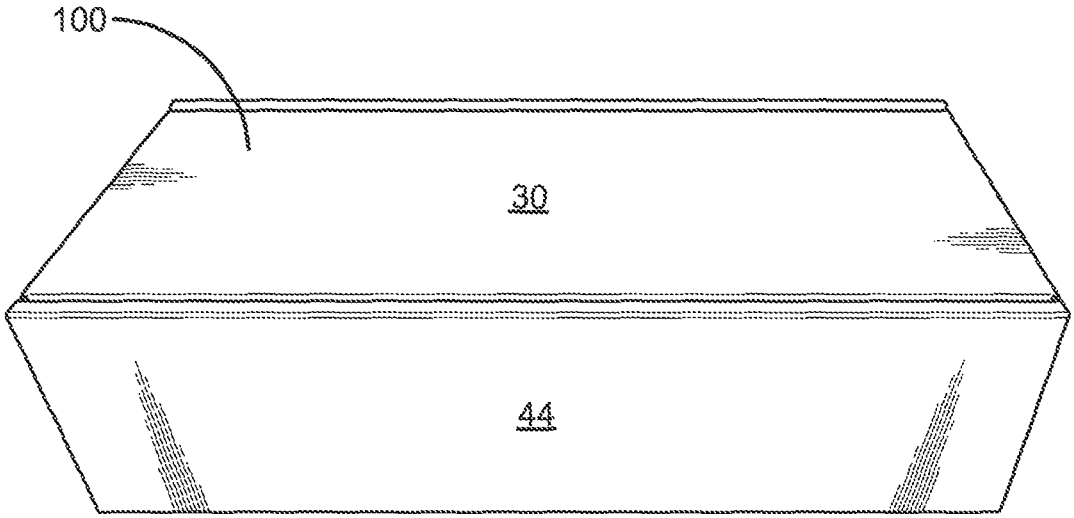
FIG. 4 shows a perspective side view of the box of FIG. 3 in a closed configuration.
Figure 5:
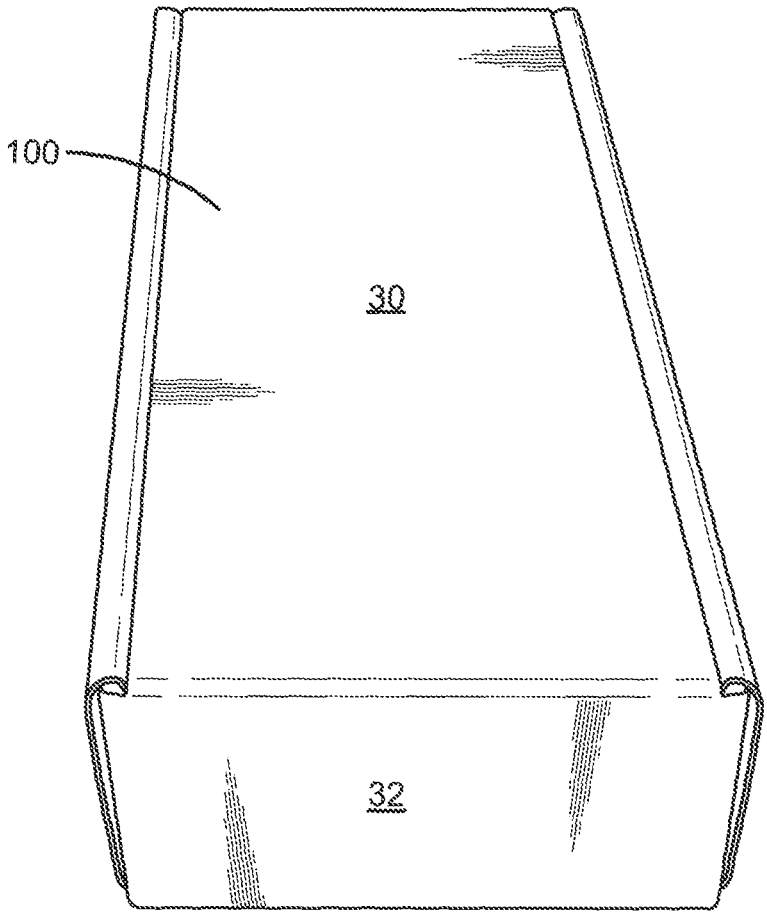
FIG. 5 shows a front view of the box of FIG. 3 in a closed configuration.
Figure 6:
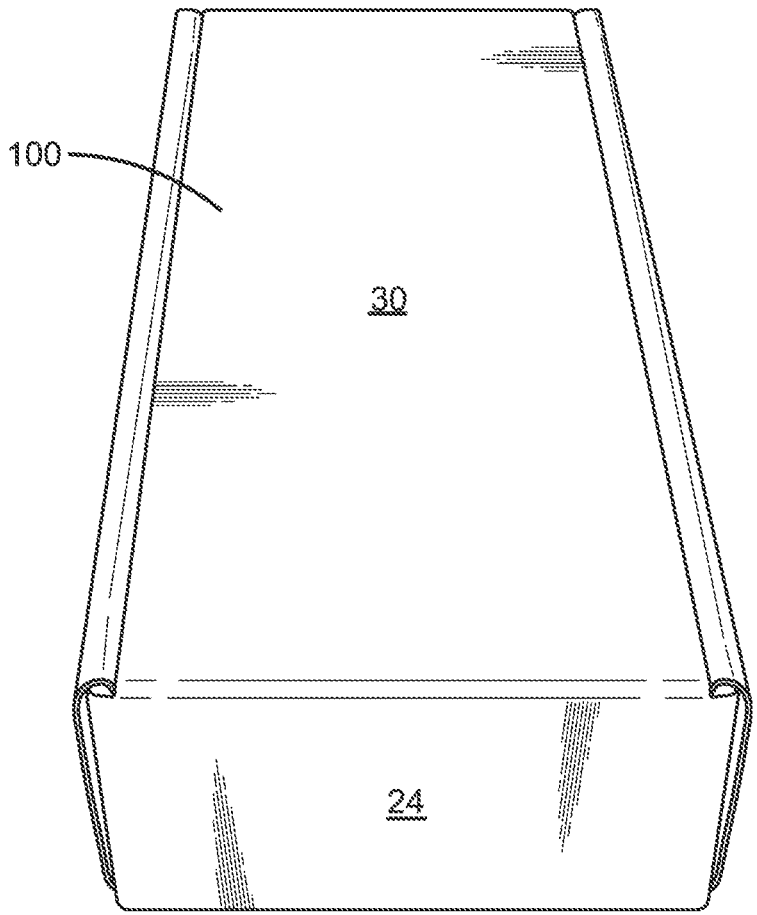
FIG. 6 shows a back view of the box of FIG. 3 in a closed configuration.
Figure 7:
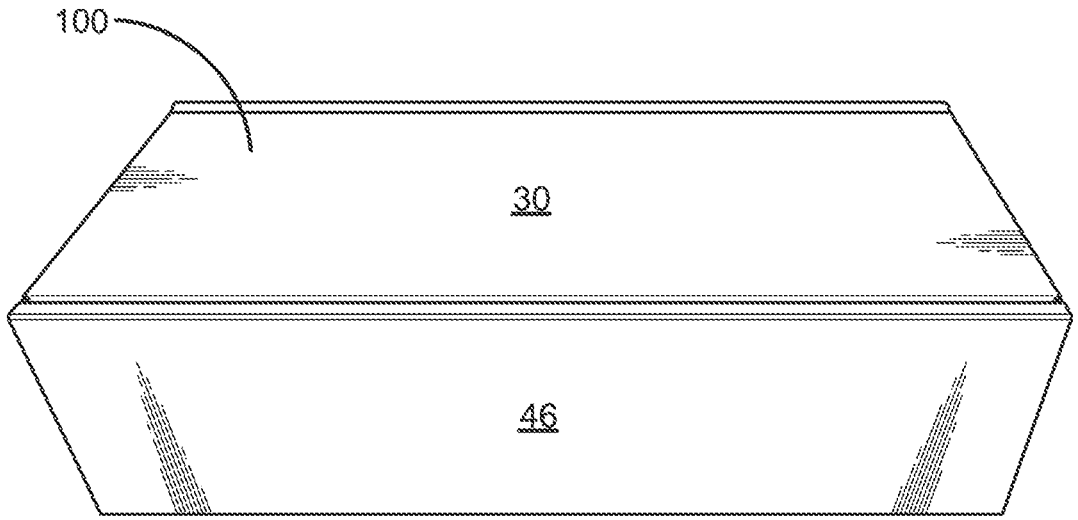
FIG. 7 shows a side view of the box of FIG. 3 in a closed configuration.
Figure 8:
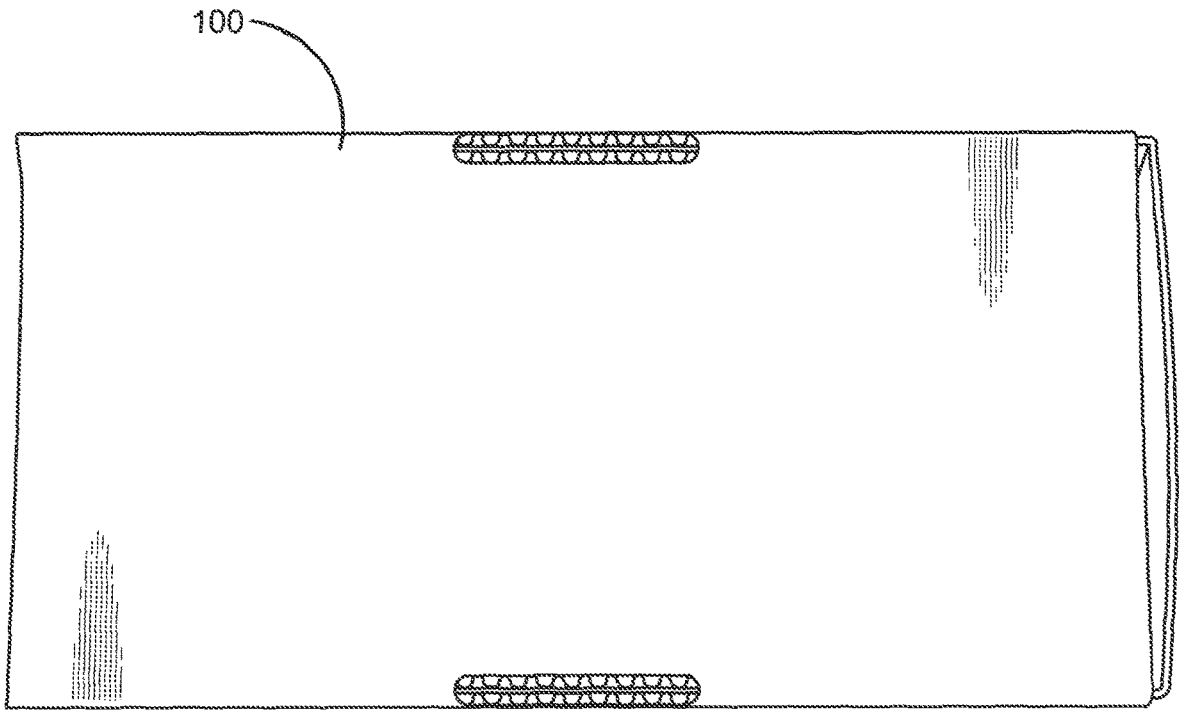
FIG. 8 shows a bottom view of the box of FIG. 3 in a closed configuration.
Figure 9:
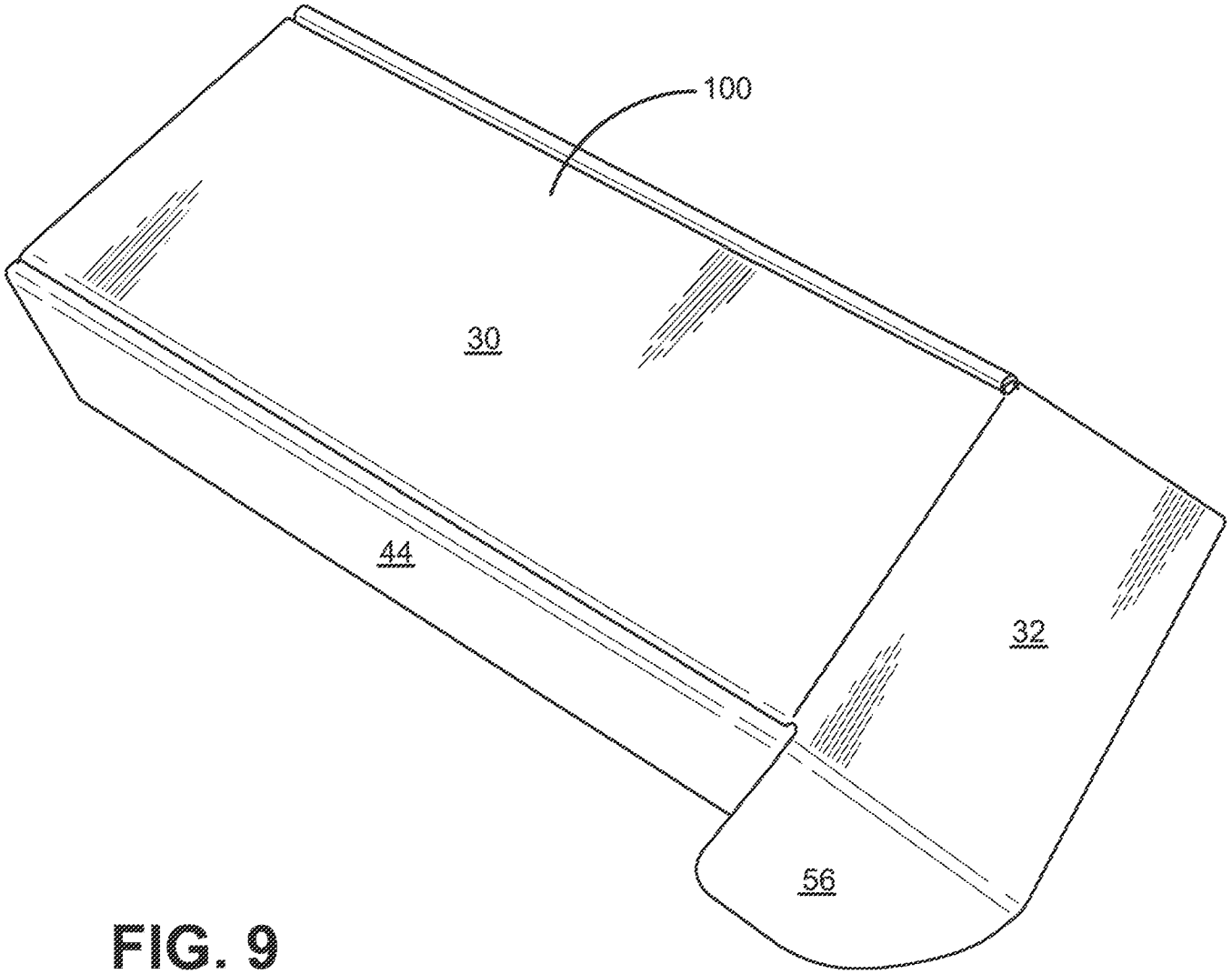
FIG. 9 shows a perspective of the box of FIG. 3 beginning to open.
Figure 10:
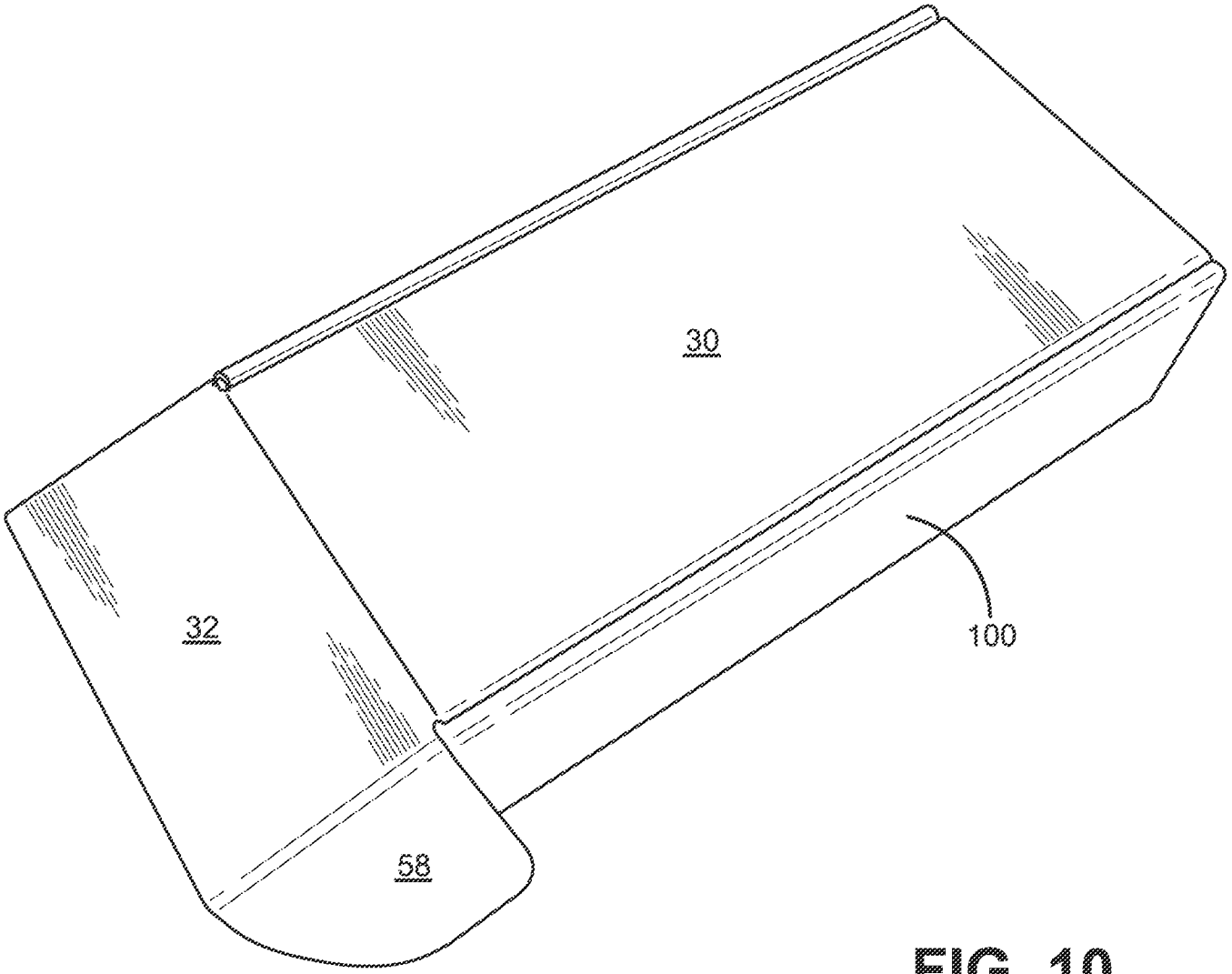
FIG. 10 shows a side perspective view of FIG. 10.
Figure 11:
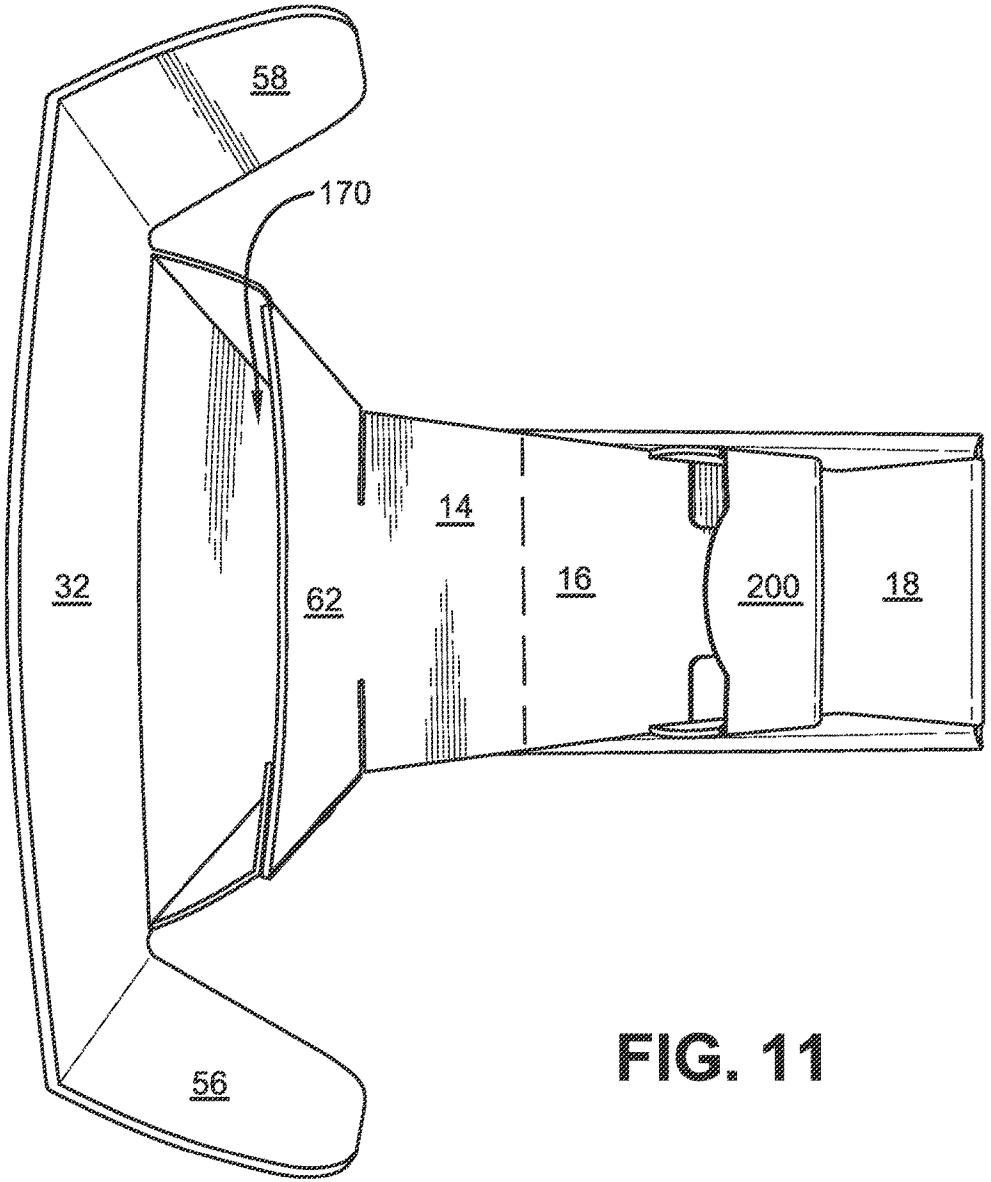
FIG. 11 shows a top view of the box of FIG. 3 in an open configuration.
Figure 12:
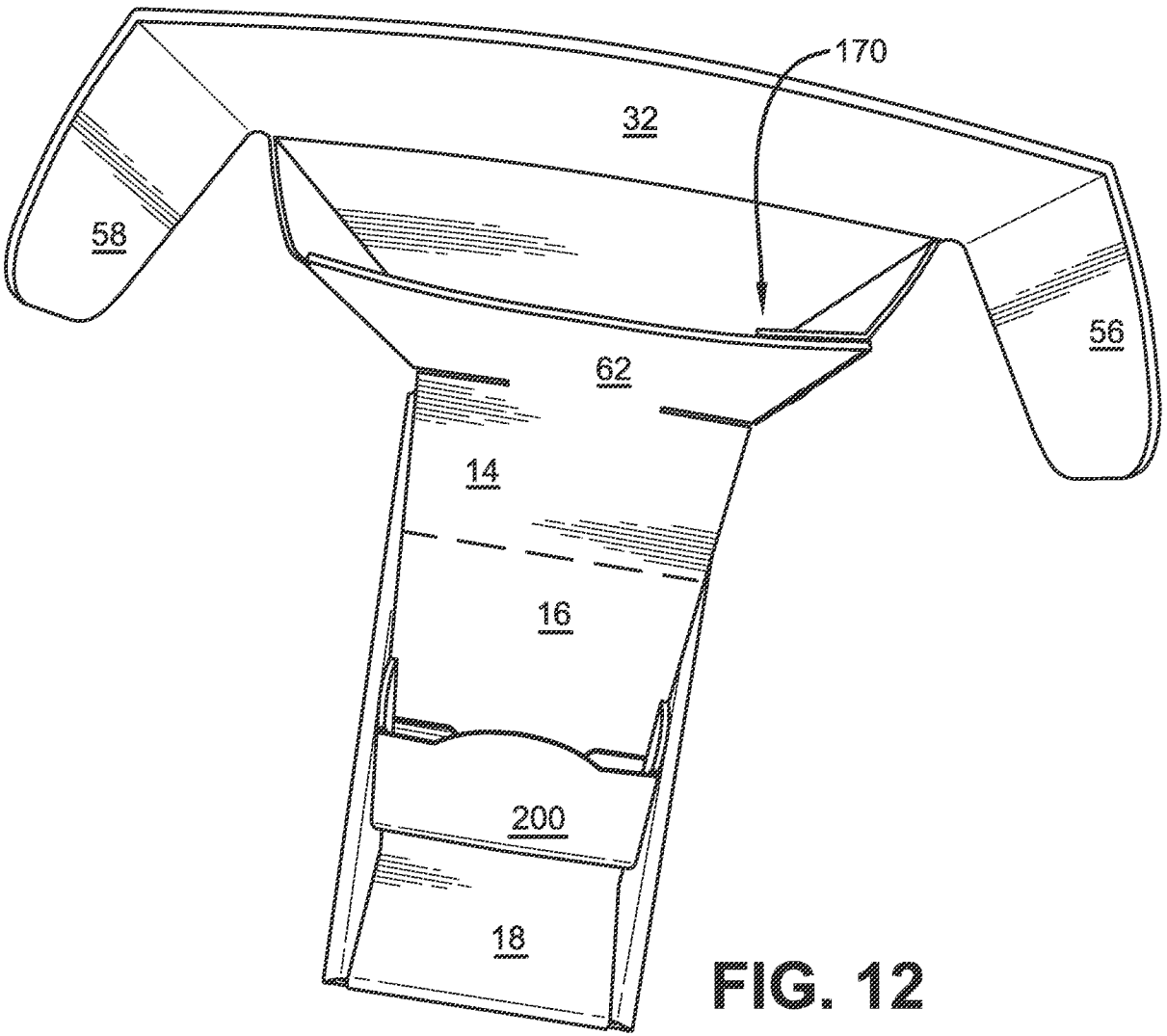
FIG. 12 shows a top front view of the box of FIG. 3 in an open configuration.
Figure 13:
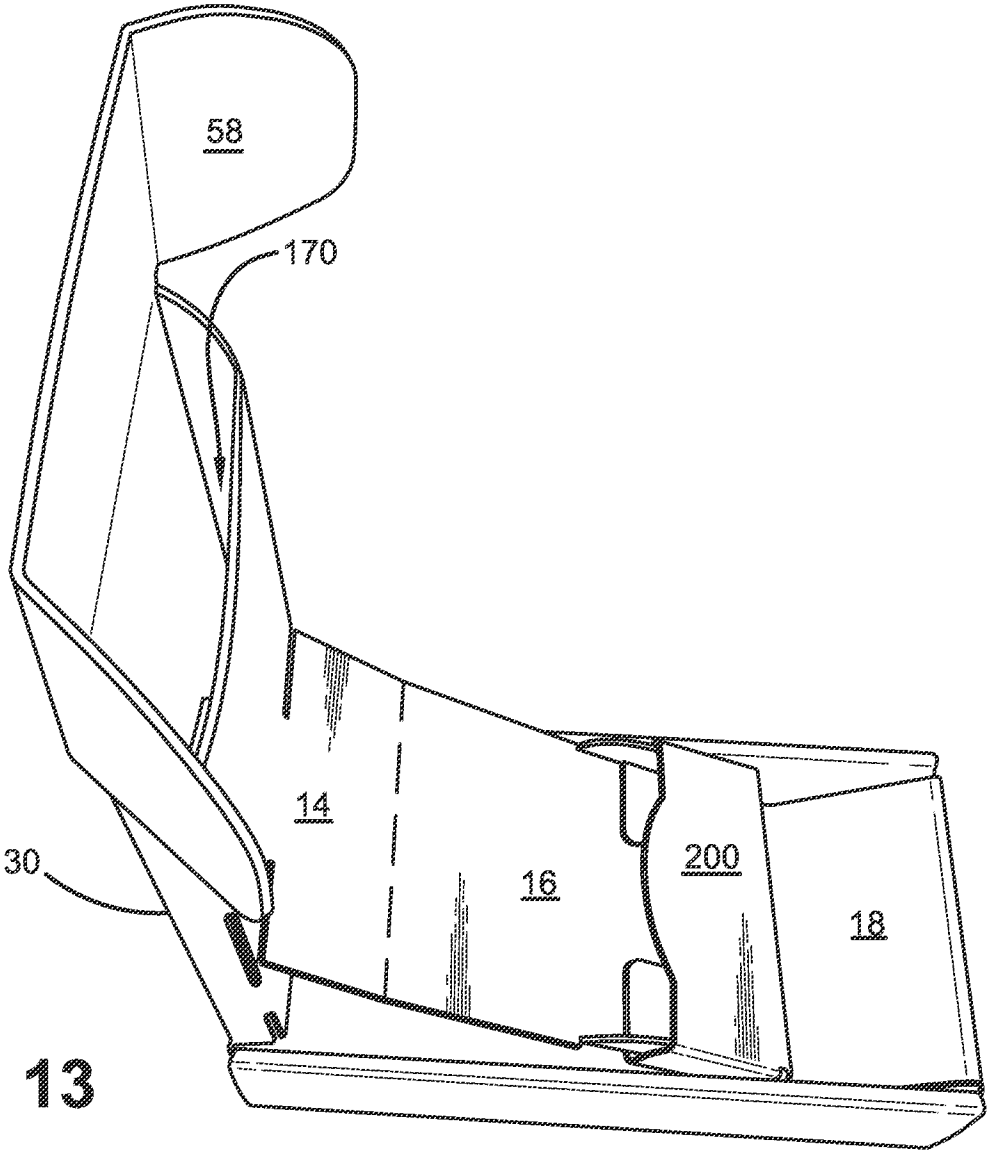
FIG. 13 shows a top side view of the box of FIG. 3 in an open configuration.
Figure 14:
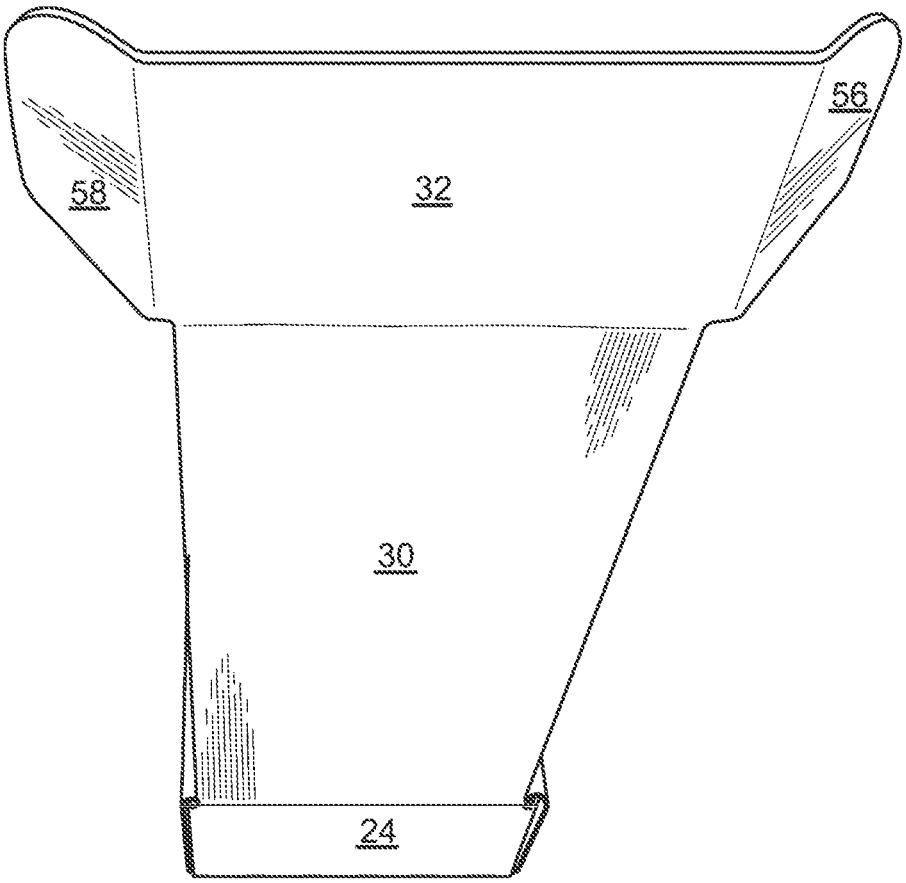
FIG. 14 shows a back view of the box shown in FIG. 12.
Figure 15:
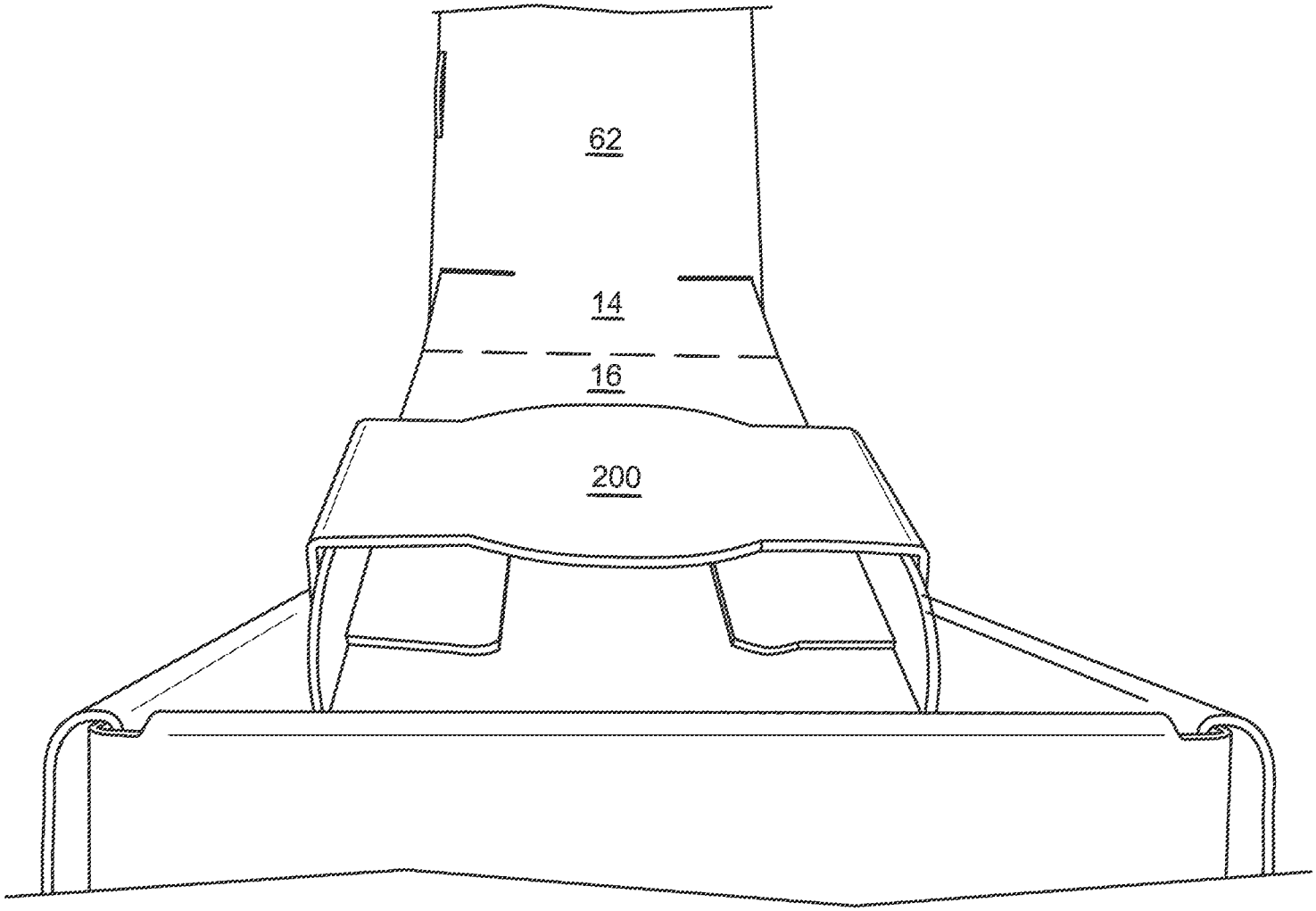
FIG. 15 shows a close up view of a product strap component of the box of FIG. 3.
Figure 16:
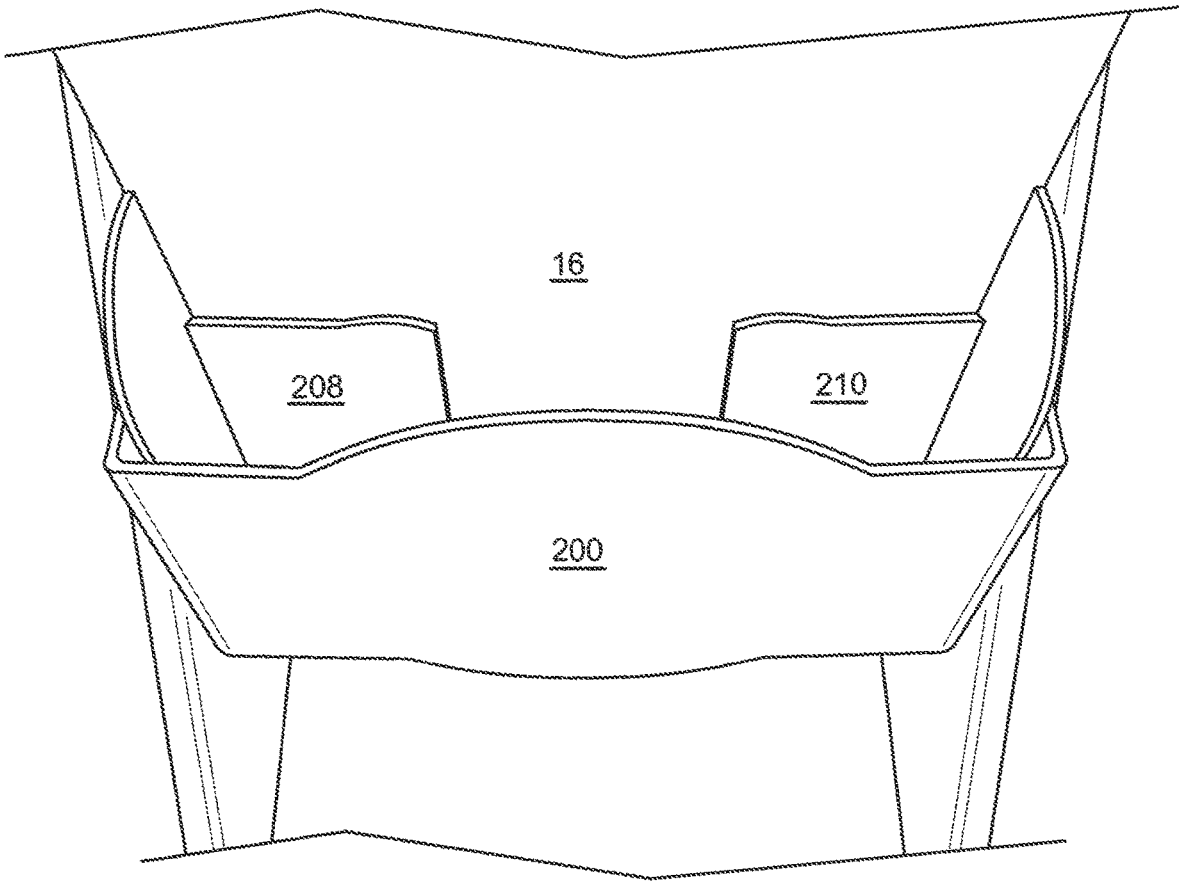
FIG. 16 shows a close up view of a product strap component of the box of FIG. 3.

An exemplary embodiment of the box is shown in FIGS. 3 through 17. FIG. 3 shows a top view of the box in a closed configuration. FIG. 4 shows a perspective side view of the box in a closed configuration. FIG. 5 shows a front view of the box in a closed configuration. FIG. 6 shows a back view of the box in a closed configuration. FIG. 7 shows a side view of the box in a closed configuration. FIG. 8 shows a bottom view of the box in a closed configuration. FIG. 9 shows a first side perspective view of the box beginning to open with the flap portion 32 and the first side insert portion 56 and the second side insert portion 58 (not viewable) removed from the interior of the box. FIG. 10 shows a second side perspective view of the box beginning to open with the flap portion 32 and the first side insert portion 56 (not viewable) and the second side insert portion 58 removed from the interior of the box. FIG. 11 shows the box in an open configuration with the cover portion 30 being positioned at approximately 90° with respect to the base of the box and the platform portion 16 being angled upwards for displaying items stored in the box and an inside cover product holder 170 also for displaying items stored in the box. FIG. 12 is a top view of FIG. 11 showing the box in an open configuration. FIG. 13 is a side view of FIG. 11 showing the box in an open configuration. FIG. 14 is a back view of FIG. 11 showing the box in an open configuration. FIG. 15 shows the product strap 200 of the box from a bottom view of the box and FIG. 16 shows the product strap 200 of the box from a top view of the box.

Figure 1:
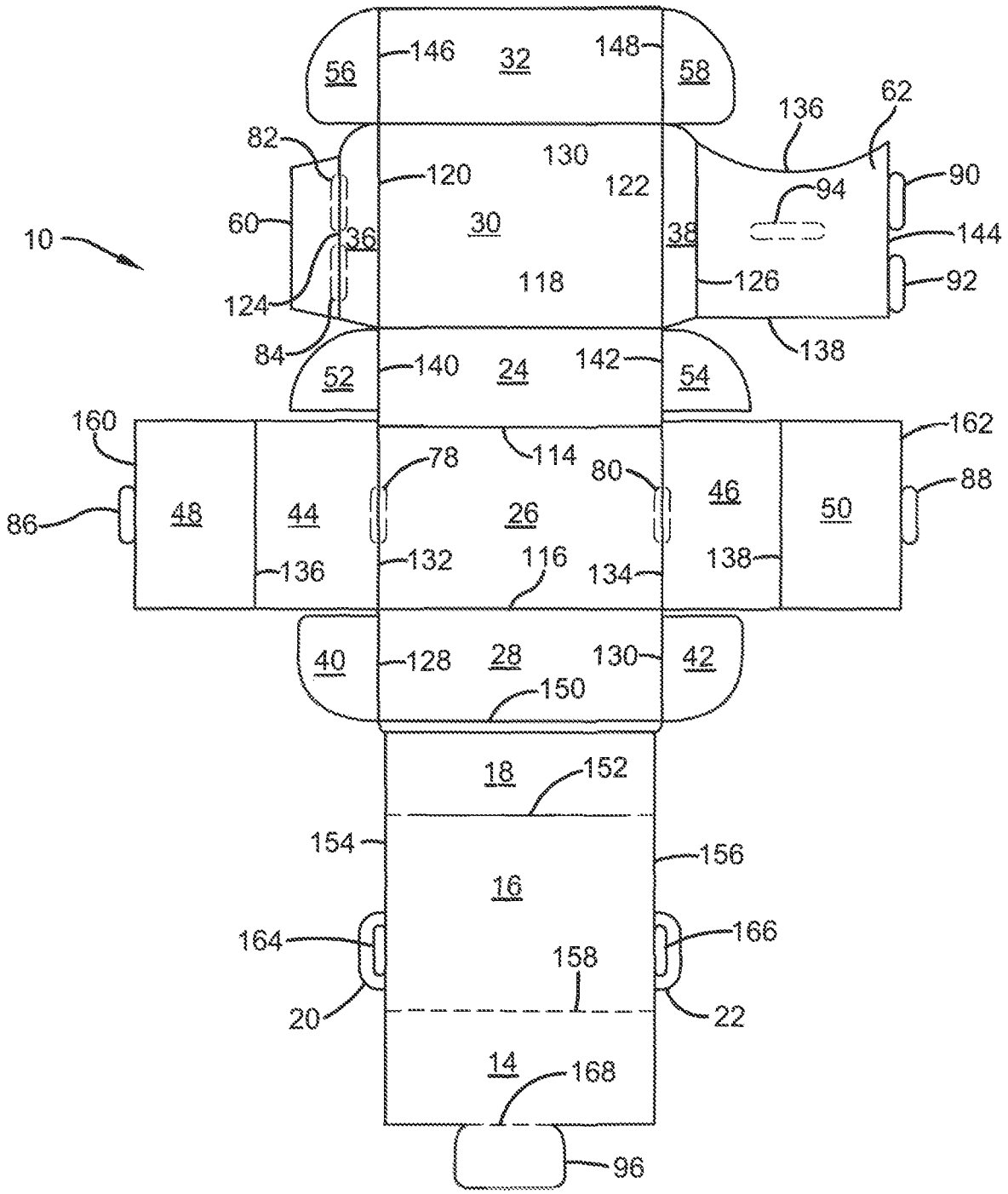
FIG. 1 shows an exemplary embodiment of a box blank.

Formation of the box will be discussed with reference to FIG. 1. FIG. 1 illustrates a box blank 10 having a one-dimensional or substantially one-dimensional configuration with a plurality of fold lines. The blank 10 may be initially flat or substantially flat. The blank 10 is designed to be folded along its fold lines to form a three-dimensional configuration of the box. The blank includes an outer side and an inner side. The outer side of the blank forms a portion of the exterior facing surface and a portion of the interior facing surface of the box when it is in its three-dimensional configuration. The inner side of the blank forms a portion of the interior facing surface and a portion of the exterior facing surface of the box when it is in its three-dimensional configuration. The blank may be made of cardboard or any material known by persons of ordinary skill in the art to be suitable for forming a box.

According to certain aspects of the present teaching, the blank 10 includes a plurality of different sections referred to herein as portions which are separated by various fold lines. The blank 10 includes a top side and a bottom side. The fold lines allow portions of the box to be folded upward direction or in a downward direction. The upward and downward folding of portions of the box blank may be clockwise or counterclockwise depending on the perspective one viewing how the box blank is being folded. Formation of the box from its one-dimensional configuration to its three-dimensional configuration may begin with the base portion 26 which forms the bottom of the box. The base portion 26 includes a first side, second side opposing the first side, a third side, a fourth side opposing the third side, a top side, and a bottom side. The base portion 26 is surrounded by four side portions which form the sidewalls of the box. These side portions include a first sidewall exterior portion 44 extending from the first side of the base portion 26, a second sidewall portion 46 extending from the second sidewall of the base portion 26, a third sidewall exterior portion 24 extending from the third side of the base portion 26, and a fourth sidewall portion 28 extending from the fourth side of the base portion 26. This manner of identifying the sides (i.e., a first side, a second side opposing a first side, a third side and a fourth side opposing the third side) of the base portion 26 is also applied to all other portions of the box blanks described herein.

First sidewall portion 44 includes an extended portion referred to as first sidewall interior portion 48 extending from the first side of the first sidewall portion. Second sidewall portion 46 includes an extended portion referred to as second sidewall interior portion 50 extending from the second side of the second sidewall portion. Third sidewall portion 24 has a first side, second side, a third side, a fourth side, a top side and a bottom side and includes a first side insert 52 adjacent its first side and a second side insert 54 adjacent its second side. Fourth sidewall portion 28 includes a first side, second side, a third side, a fourth side, a top side, and a bottom side and includes a first side insert 40 adjacent its first side and a second side insert 42 adjacent its second side.

According to certain aspects of the present teaching, the base portion 26 may include at least one slot or cutout. This slot or cutout may be positioned along the perimeter or sides of the base portion 26. According to certain teachings, the base portion 26 includes two slots 78 and 80. The first slot 78 is adjacent the perimeter of its first side portion and the second slot 80 is adjacent the perimeter of its second side portion. In certain embodiments, the first slot 78 may be positioned at or between the first side of the base portion 26 and the second side of the first sidewall exterior portion 44 and the second slot 80 may be positioned at or between the second side of the base portion 26 and the first side of the second sidewall exterior portion 46.

According to certain aspects of the present teaching, first sidewall interior portion 48 and second sidewall interior portion 50 may include at least one tab. This tab may be positioned along the perimeter of a side edge of the first sidewall interior portion 48 and the second sidewall interior portion 50. According to certain teachings, the first sidewall interior portion 48 includes tab 86 adjacent first side or edge 160 and the second sidewall interior portion 50 includes tab 88 adjacent third side or edge 162.

In forming the box, first sidewall exterior portion 44 is folded upward with respect to base portion 26 along fold line 132 and second sidewall exterior portion 46 is folded upward with respect to base portion 26 along fold line 134. First sidewall interior portion 48 is folded upward with respect to first sidewall exterior portion 44 towards base portion 26 along fold line 136. Second sidewall interior portion 50 is folded upward with respect to second sidewall exterior portion 46 towards base portion 26 along fold line 138. Tabs, if present, may be inserted in slots or cutouts positioned at or adjacent the perimeter of the base portion. Accordingly, in certain aspects of the present teaching, tab 86 adjacent first side or edge 160 of the first sidewall interior portion 48 may be inserted in slot 78 positioned between the base portion 26 and the first side exterior portion 44 and tab 88 adjacent second side or edge 162 of the second sidewall interior portion 50 may be inserted in slot 80 positioned between the base portion 26 and the second side exterior portion 46.

In continuing to form the box, third sidewall portion 24 is folded upward along fold line 114 with respect to the base portion 26 to form a back side of the box. The first side insert portion 52 is folded upward along fold line 140 with respect to the third sidewall portion 24 and the second side insert portion 54 is folded upward along fold line 142 with respect to the third sidewall portion 24. As the second sidewall portion 24 is folded upward along fold line 114 with respect to the base portion 26, the first side insert portion 52 may be positioned between the first sidewall exterior portion 44 and the first sidewall interior portion 48 secured in place by tab 86 and slot 78 and the second side insert portion 54 may be positioned between the second sidewall exterior portion 46 and the second sidewall interior portion 50 secured in place by tab 88 and slot 80.

In continuing to form the box, the fourth sidewall portion 28 is folded upward along fold line 116 with respect to the base portion 26 to form a front side of the box. The first side insert portion 40 is folded upward along fold line 128 with respect to the fourth sidewall portion 28 and the second side insert portion 42 is folded upward along fold line 130 with respect to the fourth sidewall portion 28. As the fourth sidewall portion 28 is folded upward along fold line 116 with respect to the base portion 26, the first side insert portion 40 may be positioned between the first sidewall exterior portion 44 and the first sidewall interior portion 48 secured in place by tab 86 and slot 78 and the second side insert portion 42 may be positioned between the second sidewall exterior portion 46 and the second sidewall interior portion 50 secured in place by tab 88 and slot 80.

In continuing to form the box, the blank 10 may extend from the second sidewall portion 24 to a cover portion 30. Cover portion 30 includes a first side along fold line 120, a second side along fold line 122, a third side along fold line 130 and a fourth side along fold line 118. Cover portion 30 is folded upward along fold line 118 to form a hinged top cover of the box. The cover portion 30 includes a first side portion 36 and a second side portion 38. First side portion 36 includes an extended portion referred to as cover interior insert portion 60. Second side portion 38 includes an extended portion referred to as cover interior portion 62. Cover interior portion 62 may further include a top side or top edge 136 and a bottom side or bottom edge 138. According to certain aspects of the present teaching top edge 136 may have a horizontal curvilinear shape and bottom edge 138 may have a horizontal linear shape.

According to certain aspects of the present teaching, first side portion 36 may include at least one slot and cover interior portion 62 may include at least one tab. This slot may be positioned along the perimeter of a fold line 124 between the first side of the first side portion 36 and the second side of the cover interior insert portion 60. According to certain teachings, the cover interior portion 62 includes at least one tab along its second side or outside side edge 144 capable of fitting within the slot positioned on fold line 124. According to further aspects of the present teaching, two slots 82 and 84 are positioned along fold line 124 between the first side portion 36 and the cover interior insert portion 60 and two tabs 90 and 92 are positioned along the outside edge 144 of the cover interior portion 62. The interior cover portion 62 may also include a slot 94 positioned at or about a center portion of the face of the cover interior portion or anywhere on the surface of the cover interior portion 62.

In continuing to form the box, first side portion 36 may be folded in an upward manner along fold line 120 with respect to cover portion 30 at an angle of 90° or about 90° with respect to the cover portion 30. Cover interior insert portion 60 may be folded in an upward manner along fold line 124 with respect to first side portion 36 at an angle of 90° or about 90° with respect to first side portion 36. Second side portion 38 may be folded in an upward manner along fold line 122 with respect to the cover portion 30. Interior cover portion 62 may be folded in a upward manner along fold line 126 with respect to the second side portion 38 at an angle of 90° or about 90° with respect to second side portion 38. Upon folding the cover interior insert portion 60 and the interior cover portion 62 as described above, tabs 90 and 92 positioned along outside edge 144 are fitted in slots 82 and 84 located along fold line 124, thereby forming a rectangular casing on the inside of the cover portion 30. According to certain aspects of the present teaching, an adhesive may be applied to the sides of the cover interior insert portion 60 and the cover interior portion 62 which meet together. However, it is to be understood that any other means known to a person of ordinary skill in the art (e.g., staples) may be used to secure the cover interior insert portion 60 to the cover interior portion 62.

In continuing to form the box, the blank 10 may extend from the third side of the cover portion 30 to a flap portion 32. Flap portion 32 may include a first side along fold line 146 and a second side along fold line 148. At the first side, flap portion 32 extends to first side insert portion 56 and at the second side, flap portion 32 extends to second side insert portion 58. The functionality of the flap portion 32, first side insert portion 56 and second side insert portion 58 are discussed in greater detail below.

In continuing to form the box, the blank 10 may extend from fold line 150 of the fourth sidewall portion 28 which forms the front of the box to a first intermediate platform portion 18, from the first intermediate platform portion 18 to a platform portion 16, from platform portion 16 to a second intermediate platform portion 14 and from second intermediate platform portion 14 to tabular portion 96.

The first intermediate platform portion 18 includes a first side, a second side, a third side along fold line 150 and a fourth side along fold line 152. Fold line 150 separates the first intermediate platform portion from the fourth sidewall portion. Fold line 152 separates the first intermediate platform portion 18 from platform portion 16 and provides a hinge between first intermediate platform portion 18 and platform portion 16 allowing the platform portion 16 to be angled upwards upon opening the cover portion 30 of the box and allowing the platform portion 16 to retract inside the interior portion of the box upon closing cover portion 30. According to certain aspects of the present teaching, fold line 152 may be perforated. The platform portion 16 includes a first side along edge 154, a second side along edge 156, a third side along fold line 152, and a fourth side along fold line 158. According to certain aspects of the present teaching, fold line 158 may be perforated. Platform portion 16 extends from its fourth side along fold line 158 to a second intermediate platform portion 14. The second intermediate platform portion 14 includes a first side, a second side, a third side along fold line 158, and a fourth side along fold line 168. Fold line 158 separates the platform portion 16 from the second intermediate platform portion 14 and provides a hinge between the platform portion 16 and the second intermediate platform portion 14 allowing the platform portion to be angled upwards upon opening the cover portion 30 of the box and allowing the platform portion 16 to retract inside the box upon closing the cover portion 30. The fourth side of the second platform portion 14 extends from fold line 168 to a tabular portion 96. In forming the box, tabular portion 96 is inserted and/or fitted inside slot 94 of interior cover portion 62. Thus, the tabular portion 96 is fitted inside a storage area created between the interior cover portion 62 and the cover portion 30. In use, the tabular portion functions as a brace capable of supporting various objects or items that may be stored in the storage area between the interior cover portion 62 and the cover portion 30. Examples of items that may be stored in this storage area include pamphlets, brochures, cigarettes, cigars, pens, pencils, etc.

In forming the box, the first intermediate platform portion 18 extends from the front side of the box 28 and is folded upward along fold line 150 into the interior of the box. First intermediate platform portion 18, second intermediate platform portion 14 and tabular portion 96 are connected to interior cover portion 62 by inserting and/or fitting tabular portion 96 into slot 94 to form a lift mechanism in the interior of the box. the lift mechanism allows for raising the platform portion 16 at an angle with the opening and closing of the cover portion 30 of the box. This lift mechanism may also be referred to as an interior box elevator.

The platform portion includes a first side positioned along edge 154, a second side positioned along edge 156, a third side positioned along fold line 152, and a fourth side positioned along fold line 158. According to certain aspects of the present teaching, platform portion 16 may include a first flange portion 20 positioned along edge 154 and a second flange portion 22 positioned along edge 156 on the side opposite the first flange portion. The first flange portion 20 may include a slot 164 and the second flange portion 166 may include a slot 166. Edge 154 extends into fold line 154 allowing the first flange portion 20 to be folded upward in a clockwise manner and edge 156 extends into fold line 156 allowing the second flange portion 22 to be folded upward in a counter clockwise manner. Folding the first flange portion 20 and the second flange portion 22 in this manner provides access to slots 164 and 166. Slots 164 and 166 allow for insertion of a product strap 200 to be positioned over the platform 16.

Figure 2:
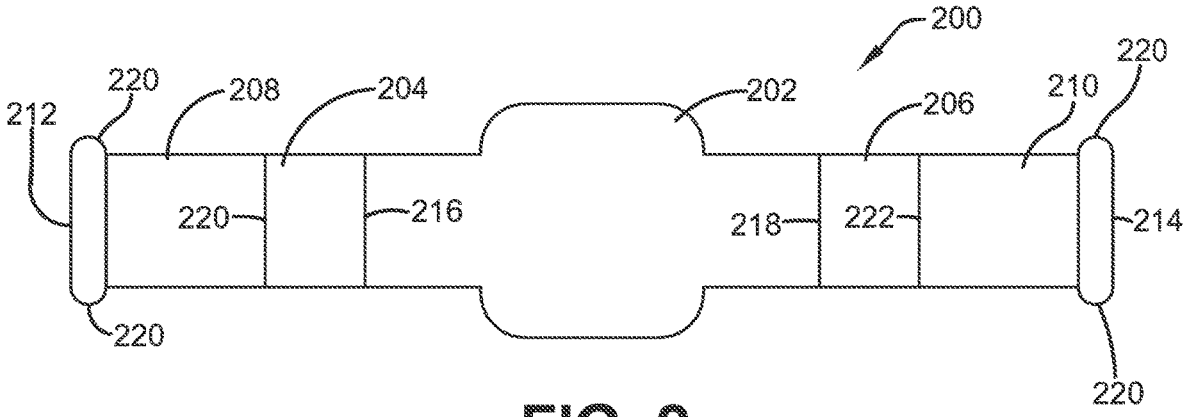
FIG. 2 shows an exemplary embodiment of a product strap for a box blank.

Product strap 200 is illustrated in FIG. 2 and includes a main body portion 202, a first side portion 204, a second side portion 206, a first connecting portion 208, a second connecting portion 210, a first end 212 and a second end 214. The first side portion 204 is formed by folding the first side portion 204 downward in a counter clockwise direction with respect to the main body portion 202 along fold line 216 and folding the first connecting portion 208 downward in a counter clockwise direction along fold line 224. The second side portion 206 is formed by folding the second side portion 206 downward in a clockwise direction with respect to the main body portion 202 along fold line 218 and folding the second connecting portion 210 downward in a clockwise direction along fold line 222. According to certain aspects of the present teaching, the first end 212 and the second end 214 of the product strap 200 may include projecting portions 220 for securing the first end 212 and the second end 214 of the product strap 200 respectively in slots 164 and 166. After folding the product strap 200 in the manner described above, the first end 212 of the product strap 200 is inserted in slot 164 and the second end of the product strap is inserted in slot 166 with the first flange 164 and the second flange 166 positioned in an upright position thus providing structural support to the bottom side of the product strap 200. Once inserted in slots 164 and 166, the first connecting portion 208 and the second connecting portion 210 are positioned directly under the main body portion 202 of the product strap 200. An adhesive may then be applied between the first connecting portion 208 (i.e., the bottom side of the first connecting portion 208 and the top side of the platform portion 16) and the platform portion 16 and between the second connecting portion 210 and the platform portion 16 (i.e., the bottom side of the second connecting portion 210 and the top side of the platform portion 16) to secure the first connecting portion 208 and the second connecting portion 210 to the platform portion 16 thus completing the formation of the product strap 200 on the box. However, it is to be understood that any other means known to a person of ordinary skill in the art (e.g., staples) may be used to secure the product strap 200 to the platform portion 16.

Figure 17:
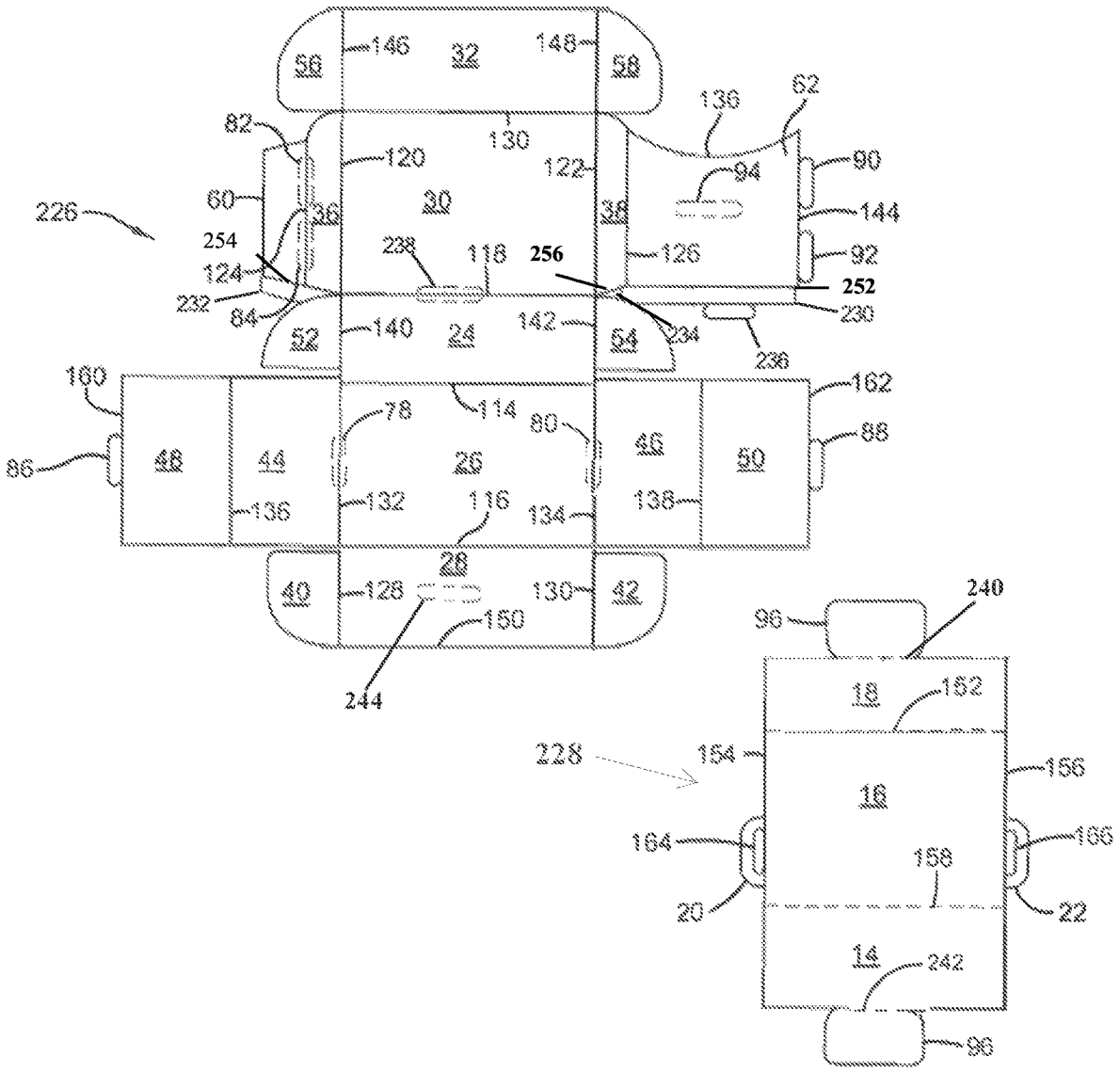
FIG. 17 shows an exemplary embodiment of two box blanks which may be fitted together to form a box.
Figure 18:
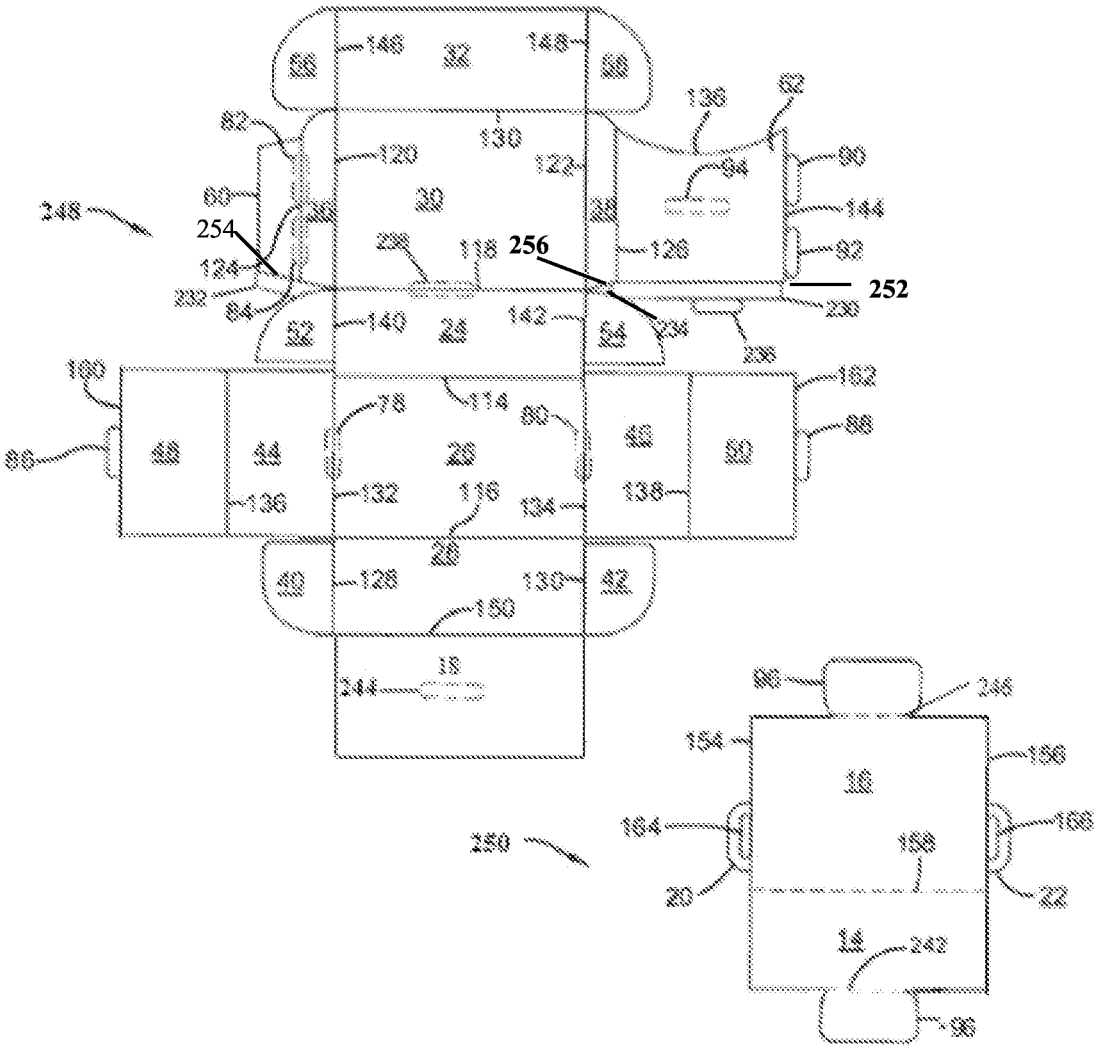
FIG. 18 shows an exemplary embodiment of two box blanks which may be fitted together to form a box.

According to further aspects of the present teaching, the box may be formed from two box blanks, namely box blank 226 and box blank 228 as shown in FIG. 18. According to FIG. 18, box blank 226 forms a main body portion of the box including the exterior of the box and box blank 228 forms the interior lifted portion of the box. In the embodiment illustrated in FIG. 17, the interior lifted portion of the box includes the platform portion, the first intermediate platform portion 18, and the second intermediate platform portion 14, as well as a first flange portion 20 and second flange portion 22 and slots 164 and 165. In this embodiment, the interior lifted portion includes two tabs 96. The first tab 96 is positioned adjacent perforated edge 242 and the second tab 96 is positioned adjacent perforated edge 240. In this embodiment the first tab 96 is inserted in slot 94 and the second tab 96 is inserted in slot 244 in the fourth sidewall portion 28 of the box. In other embodiments as illustrated in FIG. 18, the second tab 96 may be positioned adjacent perforated edge 246 adjacent platform portion 16. In this embodiment the second tab 96 pay be inserted in slot 244 which is located in the first intermediate platform portion 18, the first intermediate platform portion extending from the fourth sidewall portion as part of the box blank 248 (i.e., the first intermediate platform portion 18 is separate from box blank 250).

As further illustrated in FIGS. 17 and 18, the box blank may include a cover interior bottom portion 230 extending from the cover interior portion 62, a first side bottom portion 232 extending from the first side portion 36 of the cover portion 30 and a second side bottom portion 234 extending from the second side portion 38 of the cover portion 30. Also, a tabular portion 236 may extend from cover interior bottom portion 230 which is capable of being inserted into slot 238 position at the fold line 118 between the third sidewall portion 24 and the cover portion 30. In this embodiment, the cover interior bottom portion 230 may be folded upward along fold line 252, first side bottom portion 232 may be folded upward along fold line 254 and second side bottom portion 234 may be folded upward along fold line 256 to form a bottom portion of the storage area created between the interior cover portion 62 and the cover portion 30. This bottom portion may be secured in place by fitting tabular portion 236 inside slot 238.

The box is designed to be opened by lifting the flap portion 32 upward along fold line 130 so that the first side insertion portion 56 can be removed from the space formed between the first sidewall portion 44 and the first sidewall interior portion 48 and the second side insert portion 58 can be removed from the space formed between the third sidewall portion 46 and the third sidewall interior portion 50. The cover portion 30 may then be lifted upward along fold line 118. According to certain aspects of the present teaching, the maximum height the cover portion 30 may be lifted upward is approximately 90° with respect to the base portion 26 of the box. As the cover portion 30 is lifted upward, the third side along fold line 152 of the first intermediate platform portion 18 lifts upward causing the fourth side of the platform portion along fold line 158 to pull or extend the second intermediate platform portion 18 away from fourth sidewall portion 28 at an angle. At the same time, tabular portion 96 connected to cover interior portion 62 through slot 94 causes the second intermediate platform portion 14 and platform portion 16 to rise or lift up at an angle with respect to the front side of the box forming a display. According to certain aspects of the present teaching, various portions of the box (including but not limited to the fold lines) include a memory which provides a degree of stiffness allowing the lid of the box to remain in the open position. According to further aspects of the present teaching, the memory and stiffness of portions of the box may remain effective over an extended period of time and after repeated opening and closing of the box lid, whereas in other embodiments, the memory and stiffness of portions of the box may diminish after a certain amount of opening and closing of the box lid. According to further aspects of the present teaching, a member may be positioned below or may extend from the bottom side of the platform portion 16, the first intermediate platform portion 18 or the second intermediate platform portion 14 to the top side of the base portion 26 allowing the box to remain in the open position. To close the box, the steps described above are followed in reverse which allows fold lines 152 and 158 between the first intermediate platform portion 18 and platform portion 16 and between the second intermediate platform portion 14 and platform portion 16 to collapse platform portion 16 into the interior space inside the box.

According to certain aspects of the present teaching, the box may be formed from a box blank kit. The box blank kit may include a main body box blank which is folded as described above to form a main body of the box and a product strap blank which is folded and inserted as a separate component of the box thereby forming a product strap for holding products stored on the platform in the box. The cover interior portion 62 also provides a storage area for storing products in the box. Upon folding the cover interior portion 62 and the cover interior insert portion 60 and connecting the cover interior portion 62 to the cover interior insert portion 60, a space between the cover portion and the cover interior portion 62 is created. This space provides a storage area between the inside surface of the cover portion 30 and the inside surface of the cover interior portion allowing for products to be stored therein.

Any item may be placed on the platform 16 within the interior of the box that is capable of fitting within the space provided. According to certain aspects of the present teaching, the box is designed to hold and display cigars, cigarettes, pens, pencils or other similarly shaped items on the platform portion and/or the space or opening provided between the cover portion 30 and the cover interior portion 62 hereinafter referred to as the inside cover product holder 170.

The box embodiments described above may be formed by folding the various components of the box blanks along the respective fold lines in various directions as described above. According to certain aspects of the present teaching, all tabs described above may include projecting portions similar to projecting portion 220 for securing the tab within a corresponding slot. Also, any one or number of the fold lines described above may or may not be perforated. Moreover, although the box blanks described above may be described as having a top surface and a bottom surface. In certain instances reference to the top surface and bottom surface of the various components of the box blank described above are made with respect to the assembled box while in other instances reference to the top surface and bottom surface of the various components of the box blank described above are made with respect to an unassembled box.

LISTING OF REFERENCE NUMBERS

10—blank;
14—second intermediate platform portion;
16—platform portion;
18—first intermediate platform portion;
20—first flange portion;
22—second flange portion;
24—third sidewall portion;
26—base portion;
28—fourth sidewall portion;
30—cover portion;
32—flap portion;
36—first side portion of cover portion 30;
38—second side portion of cover portion 30;
40—first side insert of fourth sidewall portion 28;
42—second side insert of fourth sidewall portion 28;
44—first sidewall exterior portion;
46—second sidewall exterior portion;
48—first sidewall interior portion;
50—second sidewall interior portion;
52—first side insert of third sidewall portion 24;
54—second side insert of third sidewall portion 24;
56—first side insert portion of flap portion 32;
58—second side insert portion of flap portion 32;
60—cover interior insert portion;
62—cover interior portion;
78—slot;
80—slot;
82—slot;
84—slot;
86—tab;
88—tab;
90—tab;
92—tab;
96—tabular portion;
100—box;
114—fold line between third sidewall portion 24 and base portion 26;
116—fold line between base portion 26 and fourth sidewall portion 28;
118—fold line between third sidewall portion 24 and cover portion 30;
120—fold line between cover portion 30 and first side portion 36;
122—fold line between cover portion 30 and second side portion 38;
124—fold line between first side portion 36 and cover interior insert portion 60;
126—fold line between second side portion 38 and cover interior portion 62;
128—fold line between fourth sidewall portion 28 and first side insert portion 40;
130—fold line between fourth sidewall portion 28 and second side insert portion 42;
132—fold line between base portion 26 and first sidewall exterior portion 44;
134—fold line between base portion 26 and second sidewall exterior portion 46;
136—fold line between first sidewall exterior portion 44 and first sidewall interior portion 48;
138—fold line between second sidewall exterior portion 46 and second sidewall interior portion 50;
140—fold line between third sidewall portion 24 and first side insert portion 52;
142—fold line between third sidewall portion 24 and second side insert portion 54;
144—outside edge of cover interior portion 62;
146—fold line between flap portion 32 and first side insert portion 56;
148—fold line between flap portion 32 and second side insert portion 58;
150—fold line between fourth sidewall portion 28 and first intermediate platform portion 18;
152—fold line between first intermediate platform portion 18 and platform portion 16 (may be perforated);
154—edge of first side of platform portion 16;
156—edge of second side of platform portion 16;
158—fold line between platform portion 16 and second intermediate platform portion 14 (may be perforated);
160—edge of first sidewall interior portion 48;
162—edge of second sidewall interior portion 50;
164—slot;
166—slot;
168—fold line between second intermediate platform portion 14 and tabular portion 96 (may be perforated);
170—inside cover product holder;
200—product strap;
202—main body portion of product strap 200;
204—first side portion of product strap 200;
206—second side portion of product strap 200;
208—first connecting portion 208 of product strap 200;
210—second connecting portion 210 of product strap 200;
212—first end of product strap 200;
214—second end of product strap 200;
216—fold line between main body portion 202 and first side portion 204 of product strap 200;
218—fold line between main body portion 202 and second side portion 206 of product strap 200;
220—projecting portion of first end 212 and second end 214 of product strap 200;
222—fold line between second side portion 206 and second connecting portion 210 of product strap 200
224—fold line between first side portion 204 and first connecting portion 208 of product strap 200.
226—first box blank of exterior of box
228—second box blank of interior of box
230—cover interior bottom portion
232—first side bottom portion of cover interior bottom portion
234—second side bottom portion of cover interior bottom portion
236—tabular portion
238—slot
240—perforated edge between tabular portion and first intermediate platform portion 18

242—perforated edge between tabular portion and second intermediate platform portion 18

244—slot

246—perforated edge between tabular portion and platform portion 16

248—first box blank of exterior of box

250—second box blank of interior of box

252—fold line between cover interior bottom portion 230 and cover interior portion 62

254—fold line between first side bottom portion 232 and first side portion 36 of cover portion 30

256—fold line between second side bottom portion 234 and second side portion 38 of cover portion 30

As further illustrated in FIGS. 17 and 18, the box blank may include a cover interior bottom portion 230 extending from the cover interior portion 62, a first side bottom portion 232 extending from the first side portion 36 of the cover portion 30 and a second side bottom portion 234 extending from the second side portion 38 of the cover portion 30. Also, a tabular portion 236 may extend from cover interior bottom portion 230 which is capable of being inserted into slot 238 position at the fold line 118 between the third sidewall portion 24 and the cover portion 30. In this embodiment, the cover interior bottom portion 230 may be folded upward along fold line 252, first side bottom portion 232 may be folded upward along fold line 254 and second side bottom portion 234 may be folded upward along fold line 256 to form a bottom portion of the storage area created between the interior cover portion 62 and the cover portion 30. This bottom portion may be secured in place by fitting tabular portion 236 inside slot 238.

While the present invention has been illustrated by the description of exemplary embodiments thereof, and while the embodiments have been described in considerable detail, they are not intended to restrict or in any way limit the scope of the appended claims to such detail. Additional advantages and modifications will readily appear to those skilled in the art. As a non-limiting example, while operation of a box has been described herein, it will be appreciated that the box may alternatively be configured and designed. Moreover, the various features disclosed herein may be used alone or in any desired combination. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A box blank kit comprising a main body box blank, wherein the main body box blank comprises:

a base portion having a first side, a second side opposing the first side of the base portion, a third side and a fourth side opposing the third side of the base portion;

a first sidewall exterior portion which extends from the first side of the base portion and a second sidewall exterior portion which extends from the second side of the base portion;

a third sidewall portion which extends from the third side of the base portion, wherein the third sidewall portion has a first side, a second side opposing the first side of the third sidewall portion, a third side, and a fourth side opposing the third side of the third sidewall portion;

a fourth sidewall portion which extends from the fourth side of the base portion, wherein the fourth sidewall portion has a first side, a second side opposing the first side of the fourth sidewall portion, a third side, and a fourth side opposing the third side of the fourth sidewall portion;

a cover portion which extends from the third side of the third sidewall portion, wherein the cover portion has a first side, a second side opposing the first side of the cover portion, a third side, and a fourth side opposing the third side of the cover portion;

a cover interior portion having a first side, a second side opposing the first side of the cover interior portion, a third side and a fourth side opposing the third side of the cover interior portion, wherein the cover interior portion extends from—i) the first side of the cover portion or ii) the second side of the cover portion, wherein the cover interior portion comprises a slot;

a first intermediate platform portion which extends from the fourth side of the fourth sidewall portion, wherein the first intermediate platform portion has a first side, a second side opposing the first side of the first intermediate platform portion, a third side, and a fourth side opposing the third side of the first intermediate platform portion;

a platform portion which extends from the fourth side of the first intermediate platform portion, wherein the platform portion has a first side, a second side opposing the first side of the platform portion, a third side, and a fourth side opposing the third side of the platform portion;

a second intermediate platform portion which extends from the fourth side of the platform portion, wherein the second intermediate platform portion has a first side, a second side opposing the first side of the second intermediate platform portion, a third side, and a fourth side opposing the third side of the second intermediate platform portion;

a tabular portion which extends from the fourth side of the second intermediate platform portion, wherein the tabular portion fits in the slot of the cover interior portion.

2. The main body box blank of claim 1 further comprising:

a first sidewall interior portion which extends from the first sidewall exterior portion, wherein the first sidewall interior portion has a first side, a second side opposing the first side of the first sidewall interior portion, a third side, and a fourth side opposing the third side of the first sidewall interior portion; and a second sidewall interior portion which extends from the second sidewall exterior portion, wherein the second sidewall interior portion has a first side, a second side opposing the first side of the second sidewall interior portion, a third side, and a fourth side opposing the third side of the second sidewall interior portion.

3. The main body box blank of claim 2 wherein, the third sidewall portion comprises a first side insert portion which extends from the first side of the third sidewall portion and a second side insert portion which extends from the second side of the third sidewall portion, and the fourth sidewall portion comprises a first side insert portion which extends from the first side of the fourth sidewall portion and a second side insert portion which extends from the second side of the fourth sidewall portion.

4. The main body box blank of claim 3, wherein a flap portion comprises a first side insert portion which extends from the first side of the flap portion and a second side insert portion which extends from the second side of the flap portion.

5. The main body box blank of claim 4, wherein the first sidewall interior portion comprises at least one tab which extends from its first side and wherein at least one slot is positioned between the first side of the base portion and the third side of the first sidewall exterior portion corresponding to said tab and wherein the second sidewall interior portion comprises at least one tab which extends from its second side and wherein at least one slot is positioned between the third side of the base portion and the first side of the second sidewall exterior portion corresponding to said tab.

6. The main body box blank of claim 5, wherein a first side portion extends from the first side of the cover portion and a second side portion extends from the second side of the cover portion, wherein the first side portion has a first side, a second side opposing the first side of the first side portion, a third side, and a fourth side opposing the third side of the first side portion and wherein the second side portion has a first side, a second side opposing the first side of the second side portion, a third side, and a fourth side opposing the third side of the second side portion.

7. The main body box blank of claim 6, wherein the cover interior portion extends from—i) the first side portion which extends from the first side of the cover portion or ii) the second side portion which extends from the second side of the cover portion.

8. The main body box blank of claim 7 further comprising a cover interior insert portion having a first side, a second side opposing the first side, a third side and a fourth side opposing the third side of the cover interior portion, wherein the cover interior portion extends from—i) the first side portion which extends from the first side of the cover portion or ii) the second side portion which extends from the second side of the cover portion.

9. The main body box blank of claim 8, wherein the cover interior insert portion extends from the first side of the first side portion which extends from the first side of the cover portion and the cover interior portion extends from the second side of the second side portion which extends from the second side of the cover portion.

10. The main body box blank of claim 9 further comprising at least one tab positioned at the second side of the cover interior portion and at least one corresponding slot positioned between the first side of the first side portion extending from the cover portion and the second side of the cover interior insert portion.

11. The main body box blank of claim 10 comprising two tabs positioned at the second side of the cover interior portion and two corresponding slots positioned along a fold line between the first side of the first side portion extending from the cover portion and the second side of the cover interior insert portion.

12. The main body box blank of claim 11, wherein the third side of the cover interior portion comprises a concave curvilinear edge which extends from the first side of the cover interior portion to the second side of the cover interior portion.

13. The main body box blank of claim 12, wherein the third side of the cover interior portion comprises an angled edge which extends upward from the first side of the cover interior portion to the second side of the cover interior portion and wherein the fourth side of the cover interior portion comprises an angled edge which extends downward from the first side of the cover interior portion to the second side of the cover interior portion.

14. The main body box blank of claim 13, wherein— the third side of the first side portion which extends from the first side of the cover portion comprises a curvilinear edge which slopes upward from the first side of the first side portion to the second side of the first side portion of the cover portion;

the fourth side of the first side portion which extends from the first side of the cover portion comprises an angled edge which slopes downward from the first side of the first side portion to the second side of the first side portion of the cover portion;

the third side of the second side portion which extends from the second side of the cover portion comprises a curvilinear edge which slopes downward from the first side of the second side portion to the second side of the second side portion of the cover portion; and, the fourth side of the second side portion which extends from the second side of the cover portion comprises an angled edge which slopes upward from the first side of the second side portion to the second side of the second side portion of the cover portion.

15. The main body box blank of claim 14, wherein the platform portion comprises a first flange portion which extends from the first side of the platform portion and a second flange portion which extends from the second side of the platform portion.

16. The main body box blank of claim 15, wherein the first flange portion comprises a slot and the second side flange portion comprises a slot.

17. The box blank kit of claim 16, wherein the box blank kit comprises a product strap blank, wherein the product strap blank has a top side, a bottom side, a first end and a second end capable of being fitted across the platform portion by fitting a first end of the product strap inside the slot on the first side flange portion and fitting a second end of the product strap inside the slot on the second side flange portion.

18. The product strap blank of claim 17, wherein the product strap comprises a main body portion having a top side and a bottom side, wherein the top side of the main body portion extends upward from the top side of the product strap and the bottom side of the main body portion extends downward from the bottom side of the product strap.

19. The product strap blank of claim 18, wherein the first end of the product strap comprises a projecting portion which extends upward from the top side of the product strap and which extends downward from the bottom side of the product strap and wherein the second end of the product strap comprises a projecting portion which extends upward from the top side of the product strap and which extends downward from the bottom side of the product strap.

20. The product strap blank of claim 19, wherein the product strap blank comprises a first side portion adjacent a first side of the main body portion, wherein the first side portion extends towards the first end of the product strap blank and a second side portion adjacent a second side of the main body portion, wherein the second side portion extends toward the second end of the product strap blank, wherein the product strap blank comprises a first connecting portion between the first side portion and the first end of the product strap blank and a second connecting portion between the second side portion and the second end of the product strap.

21. The box blank kit of claim 20, wherein the main body box blank comprises:

a fold line between the base portion and the first sidewall exterior portion;

a fold line between the base portion and the second sidewall exterior portion;

a fold line between the base portion and the third sidewall portion;

a fold line between the base portion and the fourth sidewall portion;

a fold line between the first sidewall exterior portion and the first sidewall interior portion;

a fold line between the second sidewall exterior portion and the second sidewall interior portion;

a fold line between the third sidewall portion and the first side insert of the third sidewall portion;

a fold line between the third sidewall portion and the second side insert of the third sidewall portion;

a fold line between the third sidewall portion and the cover portion;

a fold line between the cover portion and the first side portion of the cover portion;

a fold line between the cover portion and the second side portion of the cover portion;

a fold line between the first side portion of the cover portion and the cover interior insert portion;

a fold line between the second cover exterior portion and the second cover interior portion;

a fold line between the second side portion of the cover portion and the cover interior portion;

a fold line between the cover portion and the flap portion;

a fold line between the flap portion and the first side insert portion of the flap portion;

a fold line between the flap portion and the second side insert portion of the flap portion;

a fold line between the fourth sidewall portion and the first side insert portion of the fourth sidewall portion;

a fold line between the fourth sidewall portion and the second side insert portion of the fourth sidewall portion;

a fold line between the fourth sidewall portion and the first intermediate platform portion;

a fold line between the first intermediate platform portion and the platform portion;

a fold line between the platform portion and the first flange portion;

a fold line between the platform portion and the second flange portion;

a fold line between the platform portion and the second intermediate platform portion; and a fold line between the second intermediate platform portion and the tabular portion; and wherein the product strap blank comprises:

a fold line between the main body portion and the first side portion of the product strap blank;

a fold line between the main body portion and the second side portion of the product strap blank;

a fold line between the first side portion and the first connecting portion of the product strap blank;

a fold line between the second side portion and the second connecting portion of the product strap blank;

a fold line between the first connecting portion and the first end of the product strap blank; and, a fold line between the second connecting portion and the second end of the product strap blank.

* * * * *